US012458117B2

(12) United States Patent
Roi-Sanginario

(10) Patent No.: US 12,458,117 B2
(45) Date of Patent: Nov. 4, 2025

(54) JEWELRY PIECE WITH A MAGNETIC CLOSURE FOR AN INTERCHANGEABLE ORNAMENT

(71) Applicant: Andria Arie, LLC, Westborough, MA (US)

(72) Inventor: R Alexandria Roi-Sanginario, Belmont, MA (US)

(73) Assignee: Andria Arie, LLC, Westborough, MA (US)

( * ) Notice: Subject to any disclaimer, the term of this patent is extended or adjusted under 35 U.S.C. 154(b) by 42 days.

(21) Appl. No.: 18/645,727

(22) Filed: Apr. 25, 2024

(65) Prior Publication Data

US 2024/0292930 A1 Sep. 5, 2024

Related U.S. Application Data

(63) Continuation-in-part of application No. 17/806,496, filed on Jun. 12, 2022, now Pat. No. 12,042,028, which is a continuation-in-part of application No. 17/122,232, filed on Dec. 15, 2020, now Pat. No. 11,388,962.

(60) Provisional application No. 62/950,999, filed on Dec. 20, 2019.

(51) Int. Cl.
*A44C 25/00* (2006.01)

(52) U.S. Cl.
CPC ..... *A44C 25/001* (2013.01)

(58) Field of Classification Search
CPC ..... A44C 17/0208; A44C 17/0216; A44C 17/0225; A44C 25/001; A44C 25/002; A44C 25/004; A44C 25/00; A44C 17/02; A44C 25/005; A44C 25/007; A44C 5/10; A44C 5/107
USPC ..... 63/40, 41, 23, 29.1
See application file for complete search history.

(56) References Cited

U.S. PATENT DOCUMENTS

| | | | | |
|---|---|---|---|---|
| 1,182,534 | A | 5/1916 | Driggott | |
| 1,712,171 | A | 5/1929 | Rochas | |
| 2,396,214 | A * | 3/1946 | Tabellario | A44C 3/00 63/18 |
| 3,307,375 | A | 3/1967 | Estrin et al. | |
| 3,509,734 | A | 5/1970 | Lederer | |
| 4,924,562 | A | 5/1990 | Pogharian | |
| 5,279,021 | A | 1/1994 | Edgin | |
| 5,435,047 | A | 7/1995 | Colpo | |

(Continued)

FOREIGN PATENT DOCUMENTS

| | | | |
|---|---|---|---|
| DE | 9409946 | U1 | 6/1994 |
| WO | WO 03/030671 | A1 | 4/2003 |

*Primary Examiner* — Jack W Lavinder
(74) *Attorney, Agent, or Firm* — CHELINI IP LAW LLC; Kathryn V. Chelini

(57) ABSTRACT

A jewelry piece having a body or housing that defines a cavity sized and shaped to removably receive an interchangeable ornament and a cover or back connected to the body, such that the jewelry piece may be opened or closed. The body and cover magnetically and mechanically engage when the jewelry piece is closed to secure the ornament without the need for excessive force or an additional tool. The magnetic engagement is accomplished by magnets that are located opposite each other when the jewelry piece is closed. The mechanical engagement is accomplished by interlocking mating elements that combine to define a bail when the jewelry piece is closed.

20 Claims, 36 Drawing Sheets

(56) References Cited

U.S. PATENT DOCUMENTS

| | | | | |
|---|---|---|---|---|
| 5,586,374 | A | 12/1996 | Nishida | |
| 6,481,065 | B2 | 11/2002 | Cogdill | |
| 6,484,537 | B2 | 11/2002 | Takessian | |
| 8,375,532 | B2 | 2/2013 | Yakubovich | |
| 9,021,835 | B2 | 5/2015 | Babyak | |
| 11,382,393 | B2 | 7/2022 | Roi-Sanginario | |
| 2004/0074259 | A1 | 4/2004 | Hartgrove | |
| 2005/0150035 | A1* | 7/2005 | Marks | A41F 9/002 2/338 |
| 2010/0050689 | A1* | 3/2010 | Hurwitz | A44C 25/002 63/1.12 |
| 2010/0257706 | A1 | 10/2010 | Bak | |
| 2015/0055440 | A1* | 2/2015 | Hembo | A44C 5/14 368/276 |
| 2015/0173471 | A1 | 6/2015 | Weems | |
| 2016/0051015 | A1 | 2/2016 | Powers | |
| 2018/0249795 | A1* | 9/2018 | Fullen | A44C 7/002 |

* cited by examiner

JEWELRY PIECE WITH A MAGNETIC CLOSURE FOR AN INTERCHANGEABLE ORNAMENT

CROSS-REFERENCE TO RELATED APPLICATIONS

This application is a continuation-in-part of U.S. patent application Ser. No. 17/806,496, filed Jun. 12, 2022, which is a continuation-in-part of U.S. patent application Ser. No. 17/122,232, filed Dec. 15, 2020, which claims the benefit of U.S. Provisional Patent Application No. 62/950,999, filed Dec. 20, 2019, each of which is incorporated by reference herein in its entirety.

BACKGROUND OF THE INVENTION

Field of the Invention

The present disclosure relates to jewelry, and more particularly to jewelry pieces that allow for removable and interchangeable ornaments.

Description of the Background

It is often desirable to be able to change or replace an ornament in a piece of jewelry. For example, a wearer may tire of a piece of jewelry that has only a single, unchangeable ornament, or the ornament in the jewelry piece may become damaged, rendering the entire jewelry piece unusable. In addition, the wearer may want the ability to coordinate jewelry with clothing or accessories without having to purchase multiple jewelry pieces. Further, jewelry is often expensive and the ability to have one jewelry piece with multiple ornaments is cost-effective. The ability to use an expensive ornament in more than one jewelry piece or setting is similarly cost-effective.

Jewelry pieces with replaceable ornaments are known in the art. For example, U.S. Pat. No. 6,484,537, "Replaceable Gem Stone Setting for a Jewelry Piece," discloses a jewelry piece in which the replaceable gem is held in place by "a plurality of radially extending convergent and cantilevered spring blades." U.S. Pat. No. 6,742,359, "Jewelry Piece with a Changeable Decorative Article Setting," discloses the use of "a pivoted spring element . . . having bendable segments" to secure the decorative article. U.S. Pat. No. 7,201,021, "Jewelry Article Having Magnetic Elements and Interchangeable Settings," discloses "magnetically coupling body portions" where "at least one of the body portions is rotatable to tangentially break the magnetic coupling between the body portions to interchange the setting."

Prior art mechanisms for securing the ornaments to or into the jewelry piece, however, may wear down over time. As a result, the ornament may be only loosely retained in the jewelry piece, and may tend to rattle, become misaligned, or even come out of the jewelry piece. The rattling may also damage the ornament. Prior art mechanisms that rely solely on magnets may not be reliable, in that the wearer's movements may cause the pieces that are coupled together by the magnets to separate, or the magnets may demagnetize. As a result, the ornament may be lost or damaged.

In addition, prior art mechanisms that secure the ornament may be difficult to use. In some cases, the user must open the securing mechanism by pushing or pulling on a very small tab or protrusion and pry the mechanism open. Since these tabs or protrusions are small, the user may try to open the mechanism with their fingernails, which may chip or break the fingernails. Also, if the user is struggling to open the mechanism, the user may lose their grip on the jewelry piece or the ornament, either of which may fall to the floor and get lost or damaged. Some mechanisms require an additional tool to open and/or close the securing mechanism, and those tools may be difficult to use and may get lost. In some cases, the securing mechanism may be bulky or not aesthetically appealing, which detracts from the attractiveness of the jewelry piece.

There is a need in the art for jewelry pieces in which the ornament may be quickly and easily changed and yet is firmly secured, does not rattle, and does not accidentally fall out or become dislodged. In addition, the jewelry piece should be particularly adapted to being held in a closed position while being worn to prevent accidental loss of the ornament.

Further, the jewelry piece should be easy to open and close, with a mechanism that is simple to operate and reliable, and does not require additional tools or excessive force. In addition, the securing mechanism should minimize exterior evidence of the interchangeability of the ornament.

There is also a need in the art for a collection of such jewelry pieces, such that multiple jewelry pieces, with matching or complementary, and interchangeable, ornaments may be worn at the same time. In addition, there is a need in the art for a collection of jewelry pieces where multiple pieces accept the same interchangeable ornaments.

SUMMARY OF THE INVENTION

The present invention provides a jewelry piece or setting for an interchangeable ornament.

According to the present invention, a jewelry piece provides a body or housing, and a cover or back, that are coupled together. The body defines a cavity or recess for removably receiving an ornament. The body has a magnet and a bail mating section, and the cover has a magnet and a bail mating section. When the jewelry piece is in a closed or locked position, the body magnet and the cover magnet magnetically engage, the body bail mating section and the cover bail mating section mechanically engage, and a bail is formed. The jewelry piece is in an open or unlocked position when the body magnet and the cover magnet magnetically disengage and the body bail mating section and the cover bail mating section mechanically disengage. The body bail mating section includes two elements that are substantially parallel to each other, and they define a space between them that accommodates the cover bail mating section when the jewelry piece is in the closed position.

In an embodiment, a jewelry piece for an ornament provides a housing that includes a housing bail mating section. The housing also defines a cavity for receiving the ornament, and the housing is open at opposing ends with an open top end that abuts an upper portion of the ornament. When the ornament is received in the housing, a crown of the ornament is displayed in the open top of the housing. The jewelry piece also provides a cover. The cover includes a cover bail mating section, and the cover is coupled to an open bottom end of the housing. The cover is moveable to a closed position where it overlies at least a portion of the bottom end of the housing. When the cover is in the closed position, the housing bail mating section and the cover bail mating section interlock to form a bail, and the ornament is held in abutment against the housing top end.

In an aspect, the housing bail mating section includes a first housing bail mating element and a second housing bail mating element. The first housing bail mating element and the second housing bail mating element together define a space that is sized and shaped to accommodate the cover bail mating section when the cover is in the closed position. In another aspect, the first housing bail mating element, the second housing bail mating element, and the cover bail mating section each define an opening. When the cover is in the closed position, the three openings (the first housing bail mating element opening, the second housing bail mating element opening, and the cover bail mating section opening) align and together form an opening in the bail.

In an additional aspect, the housing bail mating section includes a first housing bail mating element and a second housing bail mating element. The bail is formed when the cover is in the closed position and the cover bail mating section is inserted into a space between the first housing bail mating element and the second housing bail mating. In another aspect, the first housing bail mating element, the second housing bail mating element, and the cover bail mating section each define an opening. When the cover is in the closed position, the three openings (the first housing bail mating element opening, the second housing bail mating element opening, and the cover bail mating section opening) align and together form an opening in the bail.

In an aspect, the jewelry piece also includes a magnetic closure having at least one magnet. In another aspect, the magnetic closure is located proximate to the bail.

In an additional aspect, the jewelry piece housing includes a housing magnet and the jewelry piece cover includes a cover magnet. When the cover is in the closed position, the housing magnet and the cover magnet are magnetically coupled. In another aspect, the housing magnet is located proximate the housing bail mating section, and the cover magnet is located proximate the cover bail mating section.

In an aspect, the cavity of the housing is sized and shaped to substantially conform to the size and the shape of the ornament.

In another aspect, the cover is open at opposing ends, with an open top end having a portion that abuts a lower portion of the ornament. When the ornament is received in the housing, a portion of the ornament is displayed in an open bottom end of the cover.

In an aspect, the housing and the cover are substantially annular, and the circumference of the bottom end of the housing is greater than the circumference of the cover. In another aspect, the housing is coupled to the cover by a hinge, and the length of the hinge is less than the length of the housing and the width of the hinge is less than the width of the housing.

In another aspect, when the cover is in the closed position, a portion of the cover abuts a lower portion of the ornament. In another aspect, the jewelry piece includes a support member that is substantially contained in a channel defined in the cover. When the cover is in the closed position, a portion of the support member abuts a lower portion of the ornament.

In another embodiment, a setting for an ornament provides a body that defines a void for removably receiving the ornament. The body also includes a body coupling member, an open top, a bottom, and a perimeter wall connecting the top and the bottom. The setting also provides a back that is connected by a hinge to the body. The back includes a back coupling member. The body coupling member includes a first body coupling element and a second body coupling element, and the first body coupling element, the second body coupling element, and the back coupling member each define an opening. When the setting is in the locked position, the body coupling member and the back coupling member engage to form a bail, and the three openings (the first body coupling element opening, the second body coupling element opening, and the back coupling member opening) are positioned so as to form an opening in the bail. The setting is moveable to an unlocked position when the body coupling member and the back coupling member disengage. A portion of the ornament is visible through the open top of the body when the ornament is received in the body, and the setting is in the locked position.

In an aspect, the back coupling member is positioned in a space between the first body coupling element and the second body coupling element to form the bail when the setting is in the locked position.

In another aspect, the setting also provides a magnetic closure having at least one magnet, where the magnetic closure is located proximate the bail.

In yet another aspect, the body also includes a body magnet located proximate the body coupling member, and the back also includes a back magnet proximate the back coupling member. When the setting is in the locked position, the body magnet and the back magnet are magnetically coupled.

In an additional embodiment, a jewelry piece for an ornament provides a housing that includes a housing magnet and a housing bail mating section. The housing defines a cavity for receiving the ornament, and the housing is open at opposing ends with an open top end having a portion that abuts an upper portion of the ornament. When the ornament is received in the housing, a crown of the ornament is displayed in the open top of the housing. The jewelry piece also provides a cover that includes a cover magnet and a cover bail mating section. The cover is coupled to an open bottom end of the housing and is moveable to a closed position overlying at least a portion of the bottom end of the housing. The housing bail mating section includes a first housing bail mating element and a second housing bail mating element. When the cover is in the closed position, the cover bail mating section is positioned in a space between the first housing bail mating element and the second housing bail mating element to form a bail, and the ornament is held in abutment against the housing top end when the cover bail mating section.

In another embodiment, a jewelry piece for an ornament provides a housing that includes a housing bail mating section. The housing defines a cavity for receiving the ornament, and the housing is open at opposing ends with a top end that has a portion that abuts an upper portion of the ornament when the ornament is received in the housing. The jewelry piece also provides a cover. The cover includes a cover bail mating section, and the cover is coupled to a bottom end of the housing. The cover is moveable to a closed position. When the cover is in the closed position, the housing bail mating section and the cover bail mating section interlock to form a bail, and the ornament is held in abutment against the portion of the housing that abuts the upper portion of the ornament.

In an aspect, a crown of the ornament is displayed in an opening in the top end of the housing when the cover is in the closed position. In another aspect, the housing bail mating section includes a first housing bail mating element and a second housing bail mating element, and the first housing bail mating element and the second housing bail mating element together define a space that is sized and shaped to accommodate the cover bail mating section when the cover is in the closed position.

In an additional aspect, the first housing bail mating element, the second housing bail mating element, and the cover bail mating section each define an opening. The opening defined in the first housing bail mating element, the opening defined in the second housing bail mating element, and the opening defined in the cover bail mating section align and together form an opening in the bail when the cover is in the closed position.

In another aspect, the housing bail mating section includes a first housing bail mating element and a second housing bail mating element, and the bail is formed when the cover is in the closed position and the cover bail mating section is inserted into a space between the first housing bail mating element and the second housing bail mating element. In still another aspect, the first housing bail mating element, the second housing bail mating element, and the cover bail mating section each define an opening, and when the cover is in the closed position, the opening defined in the first housing bail mating element, the opening defined in the second housing bail mating element, and the opening defined in the cover bail mating section align and together form an opening in the bail.

In an aspect, the jewelry piece has a magnetic closure with at least one magnet. In another aspect, the housing and the cover each include a magnet, and the housing magnet and the cover magnet magnetically couple when the cover is in the closed position. In an additional aspect, the cavity in the housing is sized and shaped to substantially conform to a size and a shape of the ornament.

In an aspect, the jewelry piece cover is open at opposing ends, and has an open top end. The open top end has a potion that abuts a lower portion of the ornament when the ornament is received in the housing, and a portion of the ornament is displayed in the bottom end of the cover.

In another aspect, the housing and the cover are substantially annular. In an additional aspect, a portion of the cover abuts a lower portion of the ornament when the cover is in the closed position.

In still another aspect, the jewelry piece housing includes a first housing bail mating element, a second housing bail mating element, and a housing bail facing or covering. When the cover is in the closed position, the cover bail mating section is inserted into a space defined by the first housing bail mating element, the second housing bail mating element, and the housing bail facing to form the bail.

In an additional embodiment, a setting for an ornament includes a body and a back. The body defines a void for receiving the ornament and includes a body coupling member, a top, a bottom, and a perimeter wall that connects the top and the bottom. The body coupling member includes a first body coupling element and a second body coupling element, and the first body coupling element, the second body coupling element, and the back coupling member each define an opening. The setting is in a locked position when the body coupling member and the back coupling member engage to form a bail. The opening defined in the first body coupling element, the opening defined in the second body coupling element, and the opening defined in the back coupling member are positioned to form an opening in the bail. When the body coupling member and the back coupling member disengage, the setting is moveable to an unlocked position. When the setting is in the locked position, a portion of the ornament is visible through an opening in top of the body when the ornament is received in the body.

In an aspect, when the setting is in the locked position, the bail is formed when the back coupling member is positioned in a space between the first body coupling element and the second body coupling element. In another aspect, the setting includes a magnetic closure with at least one magnet. In still another aspect, the body includes a body magnet located proximate the body coupling member, the back includes a magnet proximate the back coupling member, and the body magnet and the back magnet are magnetically coupled when the setting is in the locked position.

In another aspect, the body coupling member also includes a covering or facing. The back coupling member is positioned in a space defined by the first body coupling element, the second body coupling element and the covering to form the bail when the setting is in the locked position.

In an additional embodiment, a jewelry piece includes a housing with a housing magnet and a housing bail mating section, and the housing defines a cavity for receiving an ornament. The housing is open at opposing ends with an open top end having a portion that abuts an upper portion of the ornament when the ornament is received in the housing, to display a crown of the ornament in an open top of the housing. The jewelry piece also includes a cover with a cover magnet and a cover bail mating section. The cover is coupled to an open bottom end of the housing and is moveable to a closed position overlying at least a portion of a bottom end of the housing. The housing bail mating section includes a first housing bail mating element, a second housing bail mating element, and a housing bail mating covering or facing. The ornament is held in abutment against the portion of the housing that abuts the upper portion of the ornament when the cover bail mating section is positioned in a space defined by the first housing bail mating element, the second housing bail mating element, and the housing bail member covering or facing to form a bail when the cover is in the closed position. The housing magnet and the cover magnet are magnetically coupled when the cover is in the closed position.

In an aspect, the cover mating section also includes a tab or protrusion proximate a top of the jewelry piece.

In another embodiment, a jewelry piece for an ornament provides a housing that includes a housing first bail mating section. The housing also defines a cavity for receiving the ornament, and the housing is open at opposing ends with an open top end that abuts an upper portion of the ornament. When the ornament is received in the housing, a crown of the ornament is displayed in the open top of the housing. The jewelry piece also provides a cover. The cover includes a cover first bail mating section, and the cover is coupled to an open bottom end of the housing. The cover is moveable to a closed position where it overlies at least a portion of the bottom end of the housing. When the cover is in the closed position, the housing first bail mating section and the cover first bail mating section interlock to form a first bail, and the ornament is held in abutment against the housing top end. The housing piece further includes a second bail that is located approximately opposite the first bail when the cover is in the closed position.

In an aspect, the housing first bail mating section includes a first housing bail mating element and a second housing bail mating element. The first housing bail mating element and the second housing bail mating element together define a space that is sized and shaped to accommodate the cover first bail mating section when the cover is in the closed position. In another aspect, the first housing bail mating element, the second housing bail mating element, and the cover first bail mating section each define an opening. When the cover is in the closed position, the three openings (the first housing bail mating element opening, the second housing bail mating element opening, and the cover first bail mating section opening) align and together form an opening in the first bail.

In an additional aspect, the housing first bail mating section includes a first housing bail mating element and a second housing bail mating element. The first bail is formed when the cover is in the closed position and the cover first bail mating section is inserted into a space between the first housing bail mating element and the second housing bail mating. In another aspect, the first housing bail mating element, the second housing bail mating element, and the cover first bail mating section each define an opening. When the cover is in the closed position, the three openings (the first housing bail mating element opening, the second housing bail mating element opening, and the cover first bail mating section opening) align and together form an opening in the first bail.

In an aspect, the jewelry piece also includes a magnetic closure having at least one magnet. In another aspect, the magnetic closure is located proximate to the first bail.

In an additional aspect, the jewelry piece housing includes a housing magnet and the jewelry piece cover includes a cover magnet. When the cover is in the closed position, the housing magnet and the cover magnet are magnetically coupled. In another aspect, the housing magnet is located proximate the housing first bail mating section, and the cover magnet is located proximate the cover first bail mating section. In an aspect, the cavity of the housing is sized and shaped to substantially conform to the size and the shape of the ornament. In another aspect, the cover is open at opposing ends, with an open top end having a portion that abuts a lower portion of the ornament. When the ornament is received in the housing, a portion of the ornament is displayed in an open bottom end of the cover.

In an aspect, the housing and the cover are substantially annular, and the circumference of the bottom end of the housing is greater than the circumference of the cover. In another aspect, the housing is coupled to the cover by a hinge, and the length of the hinge is less than the length of the housing and the width of the hinge is less than the width of the housing. In another aspect, when the cover is in the closed position, a portion of the cover abuts a lower portion of the ornament. In another aspect, the jewelry piece includes a support member that is substantially contained in a channel defined in the cover. When the cover is in the closed position, a portion of the support member abuts a lower portion of the ornament.

In another embodiment, a setting for an ornament provides a body that defines a void for removably receiving the ornament. The body also includes a body first coupling member, an open top, a bottom, and a perimeter wall connecting the top and the bottom. The setting also provides a back that is connected by a hinge to the body. The back includes a back first coupling member. The body first coupling member includes a first body coupling element and a second body coupling element, and the first body coupling element, the second body coupling element, and the back first coupling member each define an opening. When the setting is in the locked position, the body first coupling member and the back first coupling member engage to form a bail, and the three openings (the first body coupling element opening, the second body coupling element opening, and the back first coupling member opening) are positioned so as to form an opening in the first bail. The setting is moveable to an unlocked position when the body first coupling member and the back first coupling member disengage. A portion of the ornament is visible through the open top of the body when the ornament is received in the body, and the setting is in the locked position.

In an aspect, the back first coupling member is positioned in a space between the first body coupling element and the second body coupling element to form the first bail when the setting is in the locked position. In another aspect, the setting also provides a magnetic closure having at least one magnet, where the magnetic closure is located proximate the first bail. In yet another aspect, the body also includes a body magnet located proximate the body first coupling member, and the back also includes a back magnet proximate the back first coupling member. When the setting is in the locked position, the body magnet and the back magnet are magnetically coupled.

In an additional embodiment, a jewelry piece for an ornament provides a housing that includes a housing magnet and a housing first bail mating section. The housing defines a cavity for receiving the ornament, and the housing is open at opposing ends with an open top end having a portion that abuts an upper portion of the ornament. When the ornament is received in the housing, a crown of the ornament is displayed in the open top of the housing. The jewelry piece also provides a cover that includes a cover magnet and a cover first bail mating section. The cover is coupled to an open bottom end of the housing and is moveable to a closed position overlying at least a portion of the bottom end of the housing. The housing first bail mating section includes a first housing bail mating element and a second housing bail mating element. When the cover is in the closed position, the cover first bail mating section is positioned in a space between the first housing bail mating element and the second housing bail mating element to form a bail, and the ornament is held in abutment against the housing top end when the cover bail mating section.

Although the present invention is described and illustrated herein as being implemented with a pendant, the embodiments described herein are provided as examples and are not limitations. As those skilled in the art will appreciate, the present invention may be applied with a variety of different types of jewelry pieces and with different types of ornaments.

BRIEF DESCRIPTION OF DRAWINGS

The foregoing and other features and advantages will be apparent from the following more particular description of exemplary embodiments of the disclosure, as illustrated in the accompanying drawings, in which like reference characters refer to the same parts throughout the different views. The drawings are not necessarily to scale, emphasis instead being placed upon illustrating the principles of the disclosure.

DETAILED DESCRIPTION OF THE INVENTION

Figure 1:
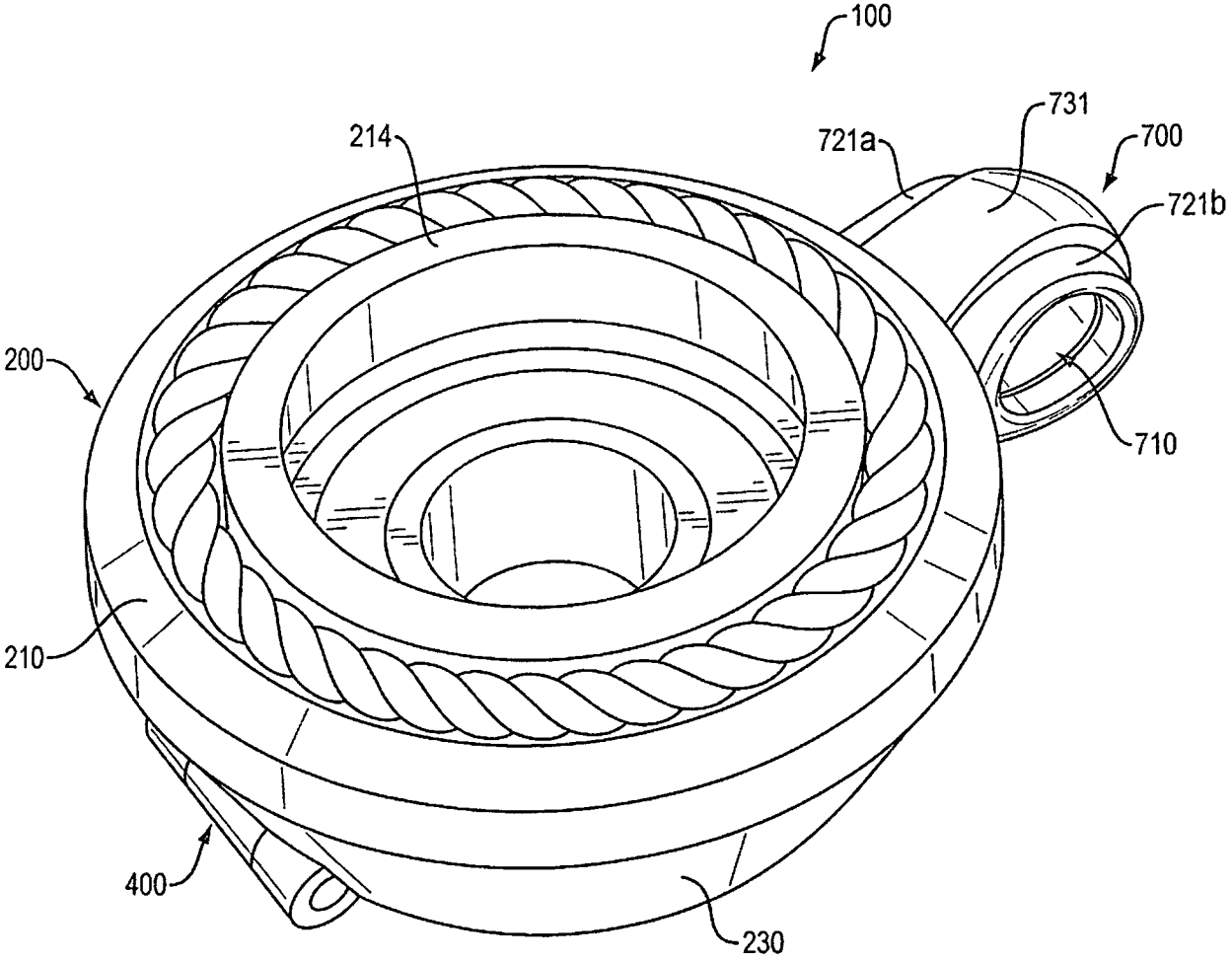
FIG. 1 is a perspective view of a jewelry piece for an interchangeable ornament in a closed position, in accordance with a preferred embodiment of the invention.

With reference to FIGS. 1-16, in a preferred embodiment, jewelry piece 100, shown as a substantially round pendant, comprises two sections: a body or housing 200 and a cover or back 300. The body 200 is coupled to the cover 300 by a hinge 400, enabling jewelry piece 100 to open and close with limited rotational movement.

Note that the jewelry piece of the invention is not limited to a pendant. In additional embodiments, the jewelry piece 100 may include, but is not limited to, a necklace, bracelet, earrings, brooch, pin, or watch. Note also that the jewelry piece 100 is not limited to a round shape. In additional embodiments, the jewelry piece 100 may be substantially any shape, and is not limited by the shape of the ornament 500.

In preferred embodiments, jewelry piece 100 is primarily composed of formable precious metals, such as gold or silver. In additional embodiments, jewelry piece 100 may be formed of other precious metals including but not limited to platinum; base metals, including but not limited to copper, tin, or zinc; stainless steel; metal alloys; plastics; bone, wood, stone, or other non-precious metals. Jewelry piece 100 is preferably manufactured by casting, but may also be manufactured by machining, soldering, die striking or a combination thereof, or may be formed by hand, or any other suitable method of manufacturing or production.

As shown in FIGS. 1-16, the jewelry piece body 200 is substantially annular and comprises a top surface 210, a bottom surface 220, and a contiguous sidewall 230 that connects the top surface 210 to the bottom surface 220. The body 200 further defines an internal space or cavity 240 for removably receiving an ornament 500. Body cavity 240 is preferably adapted and configured to conform to the shape of the ornament 500, and thus firmly secure the ornament 500 and prevent it from rattling in the cavity 240 when the jewelry piece 100 is closed, as further described below. In additional embodiments, jewelry piece body 200 and body cavity 240 may be substantially any suitable shape or size.

In a preferred embodiment, ornament 500 is a gem stone. In additional embodiments, the ornament 500 may include, but is not limited to, a precious stone, semi-precious stone, imitation stone, coin, and other small token. Note also that the shape of the ornament 500 may be substantially any shape, including but not limited to marquis, round, trillion, oval, pear or tear drop, square, octagon, emerald, baguette, antique cushion, heart-shape, briolette cabochon, faceted, and princess cut. In addition, the ornament 500 may be substantially any material, including not limited to diamond, ruby, sapphire, or any other precious or semi-precious jewelry stone, glass, crystal, pearl, mother-of-pearl, man-made stones, simulated stones, and laboratory-created stones. In additional embodiments the ornament may include precious metals, including but not limited to gold, silver, or platinum, or non-precious metals, including but not limited to stainless steel, copper, brass, bronze or nickel. In alternate embodiments the ornament may be monogrammed or etched or otherwise embellished. The ornament may also include of a plurality of any one material, for example, a set of stones, or may include a combination of any of these materials. There are no restrictions on the size of the ornament 500. In the example jewelry piece 100 shown in FIGS. 1-16, a substantially round pendant, the diameter of ornament 500 is preferably 10 or 12 millimeters.

Figure 2:
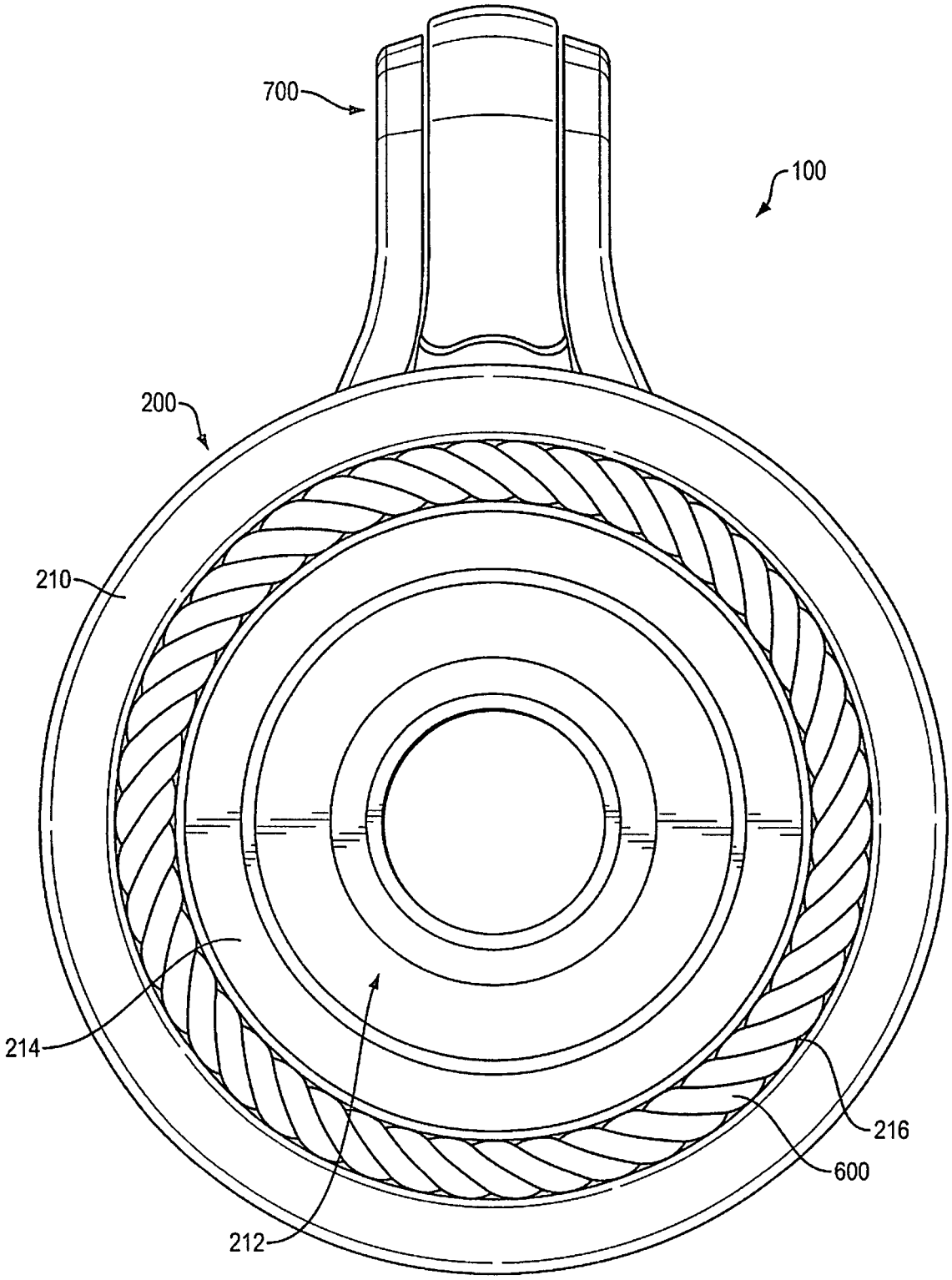
FIG. 2 is a front view of the jewelry piece of FIG. 1.
Figure 6:
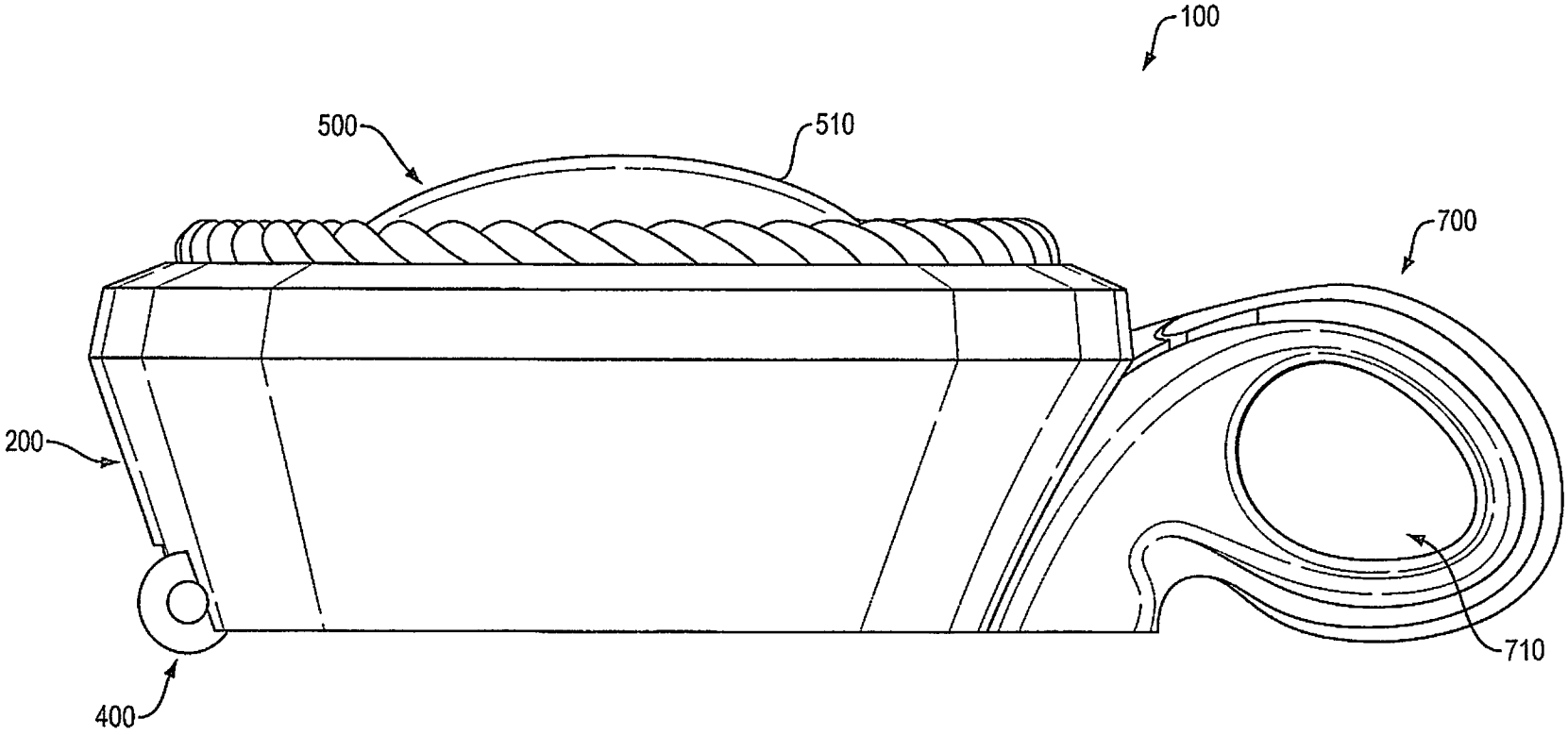
FIG. 6 is a side view of the jewelry piece of FIG. 1, with the addition of an exemplary ornament.
Figure 7:
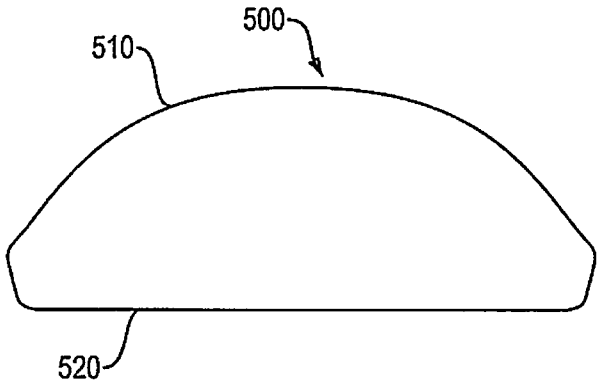
FIG. 7 is a side view of the exemplary ornament of FIG. 6.
Figure 14:
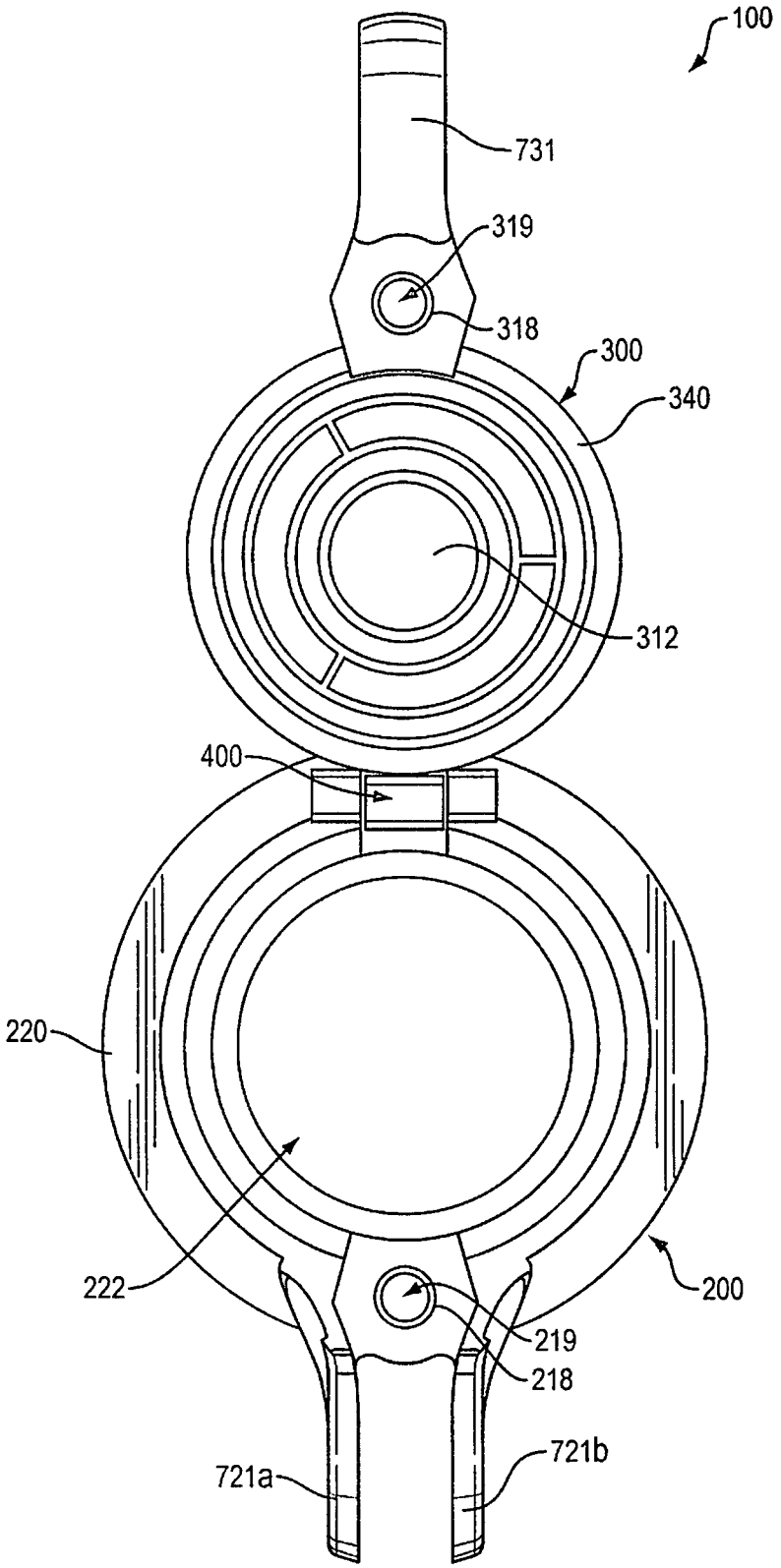
FIG. 14 is a front view of the jewelry piece of FIG. 13.
Figure 15:
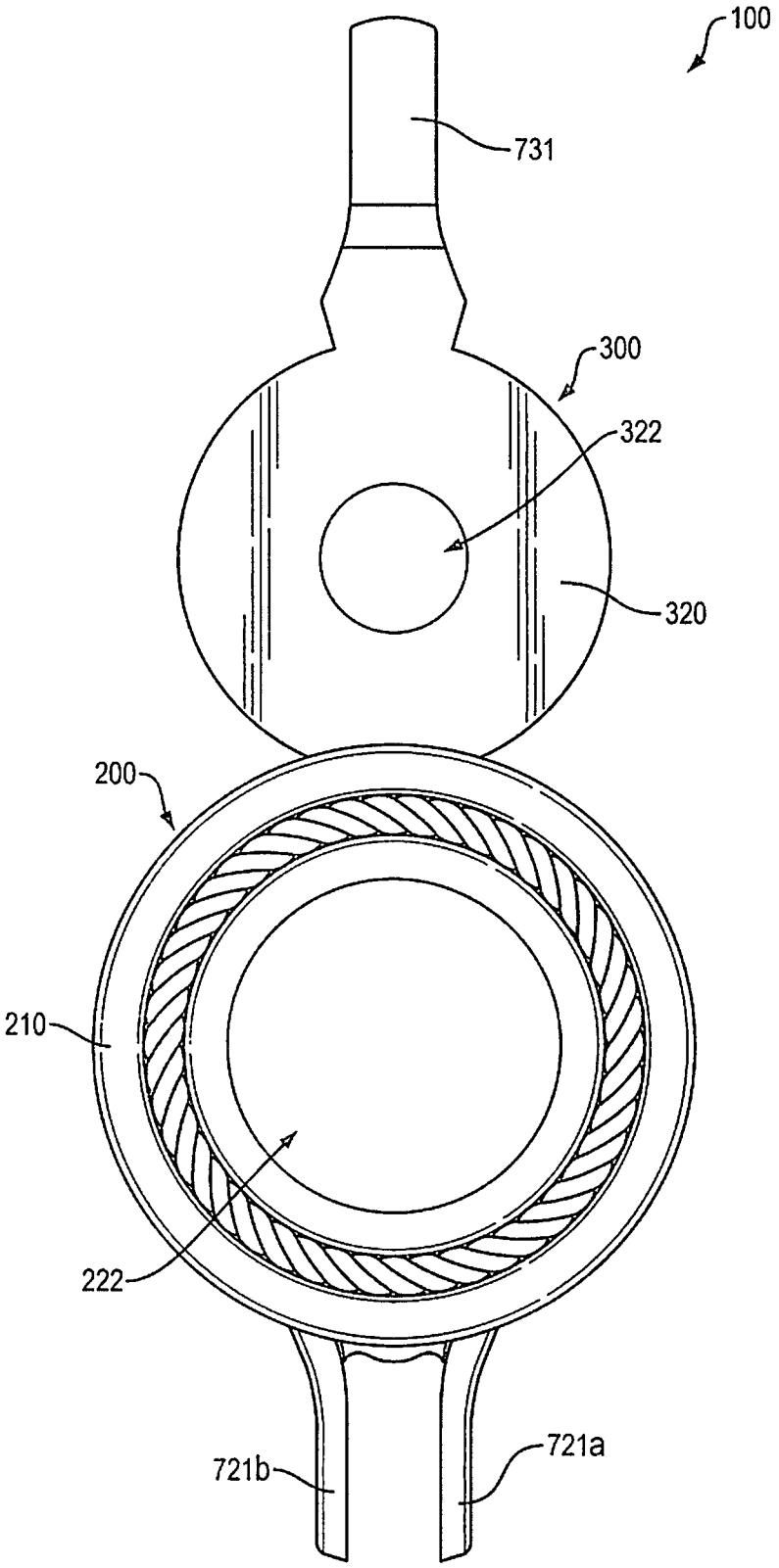
FIG. 15 is a back view of the jewelry piece of FIG. 13.
Figure 16:
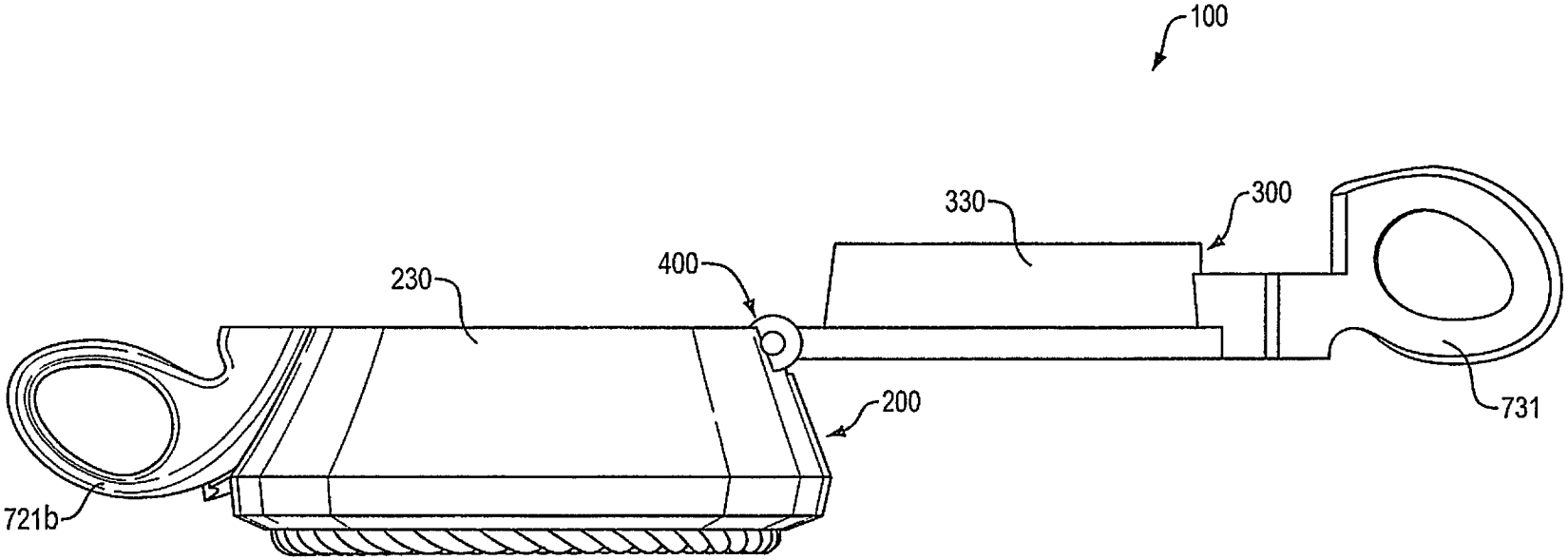
FIG. 16 is a side view of the jewelry piece of FIG. 13.

In a preferred embodiment, and with further reference to FIG. 2, the top surface 210 of the body 200 defines a first opening 212 and a rim 214 that extends substantially circumferentially around the first opening 212. With further reference to FIG. 14, the bottom surface 220 of the body 200 defines a second opening 222. The ornament 500 is inserted into the body cavity 240 through the second opening 222 in the bottom surface 220, such that the top or crown 510 of the ornament 500 abuts and may be viewed through the first opening 212 in the top surface 210, as shown in FIG. 6. The rim 214 of the top surface 210 contacts with at least a portion of the top or crown 510 of the ornament 500, and is adapted and configured to prevent the ornament 500 from falling out of the body cavity 240 through the first opening 212 in the top surface 210.

As also shown in FIG. 2, the top surface 210 of the body 200 defines a groove or channel 216 that extends substantially circumferentially around the rim 214. Channel 216 may be used to hold any type of decorative object, including but not limited to a chain 600 or small stones (not shown).

Figure 17:
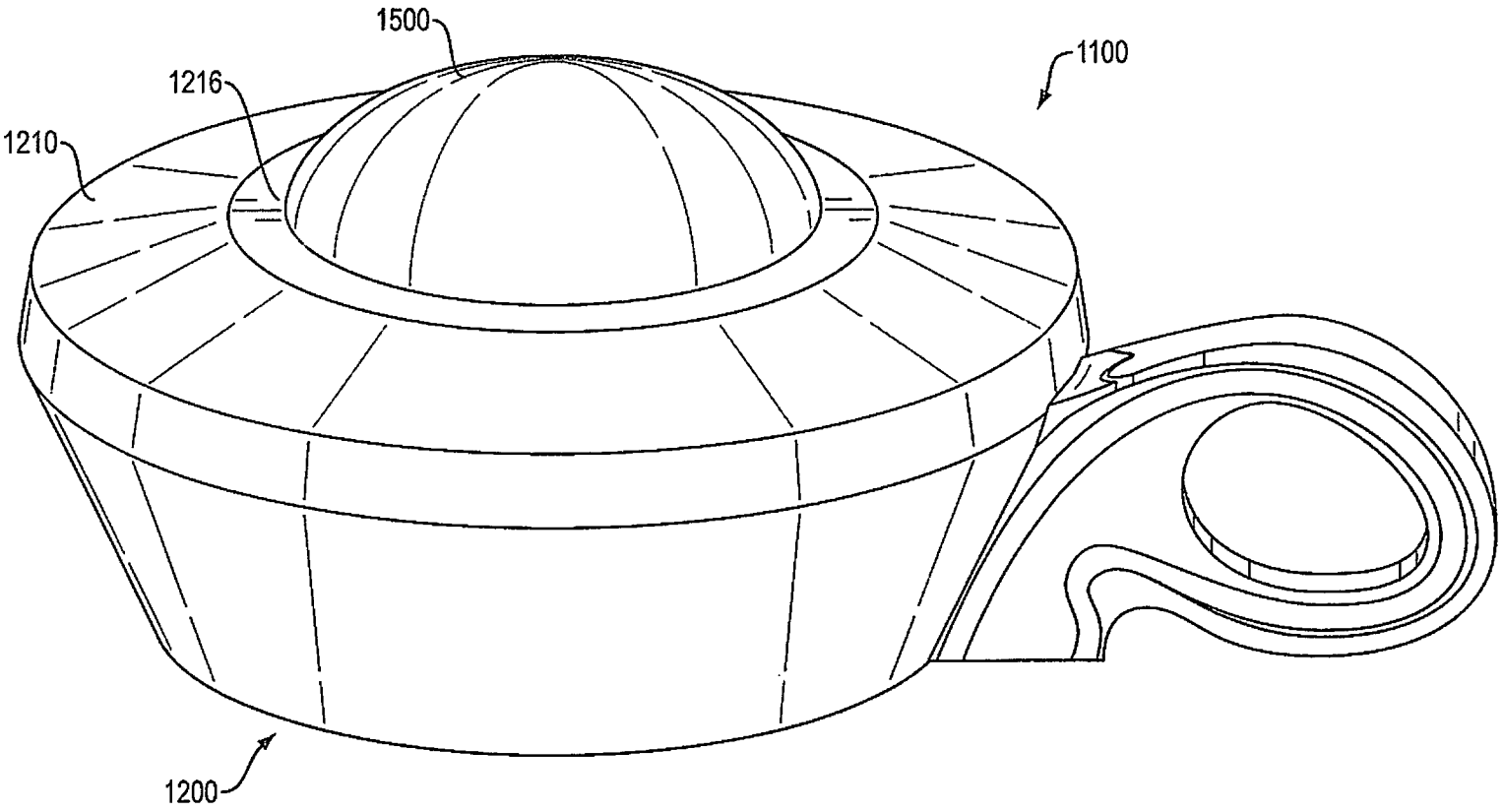
FIG. 17 is a perspective view of a jewelry piece for an interchangeable ornament in a closed position, in accordance with a first additional embodiment of the invention.
Figure 18:
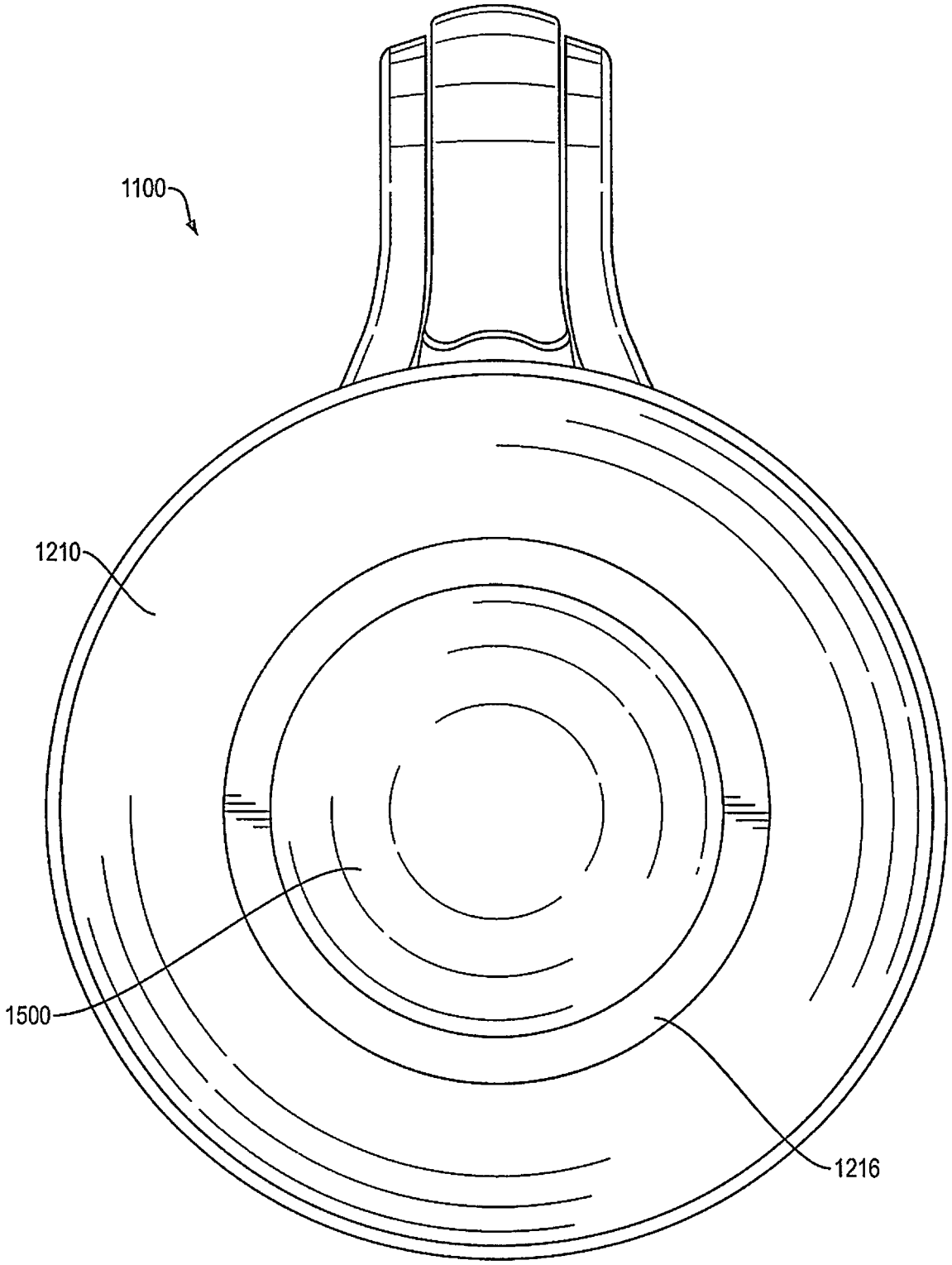
FIG. 18 is a front view of the jewelry piece of FIG. 17.
Figure 19:
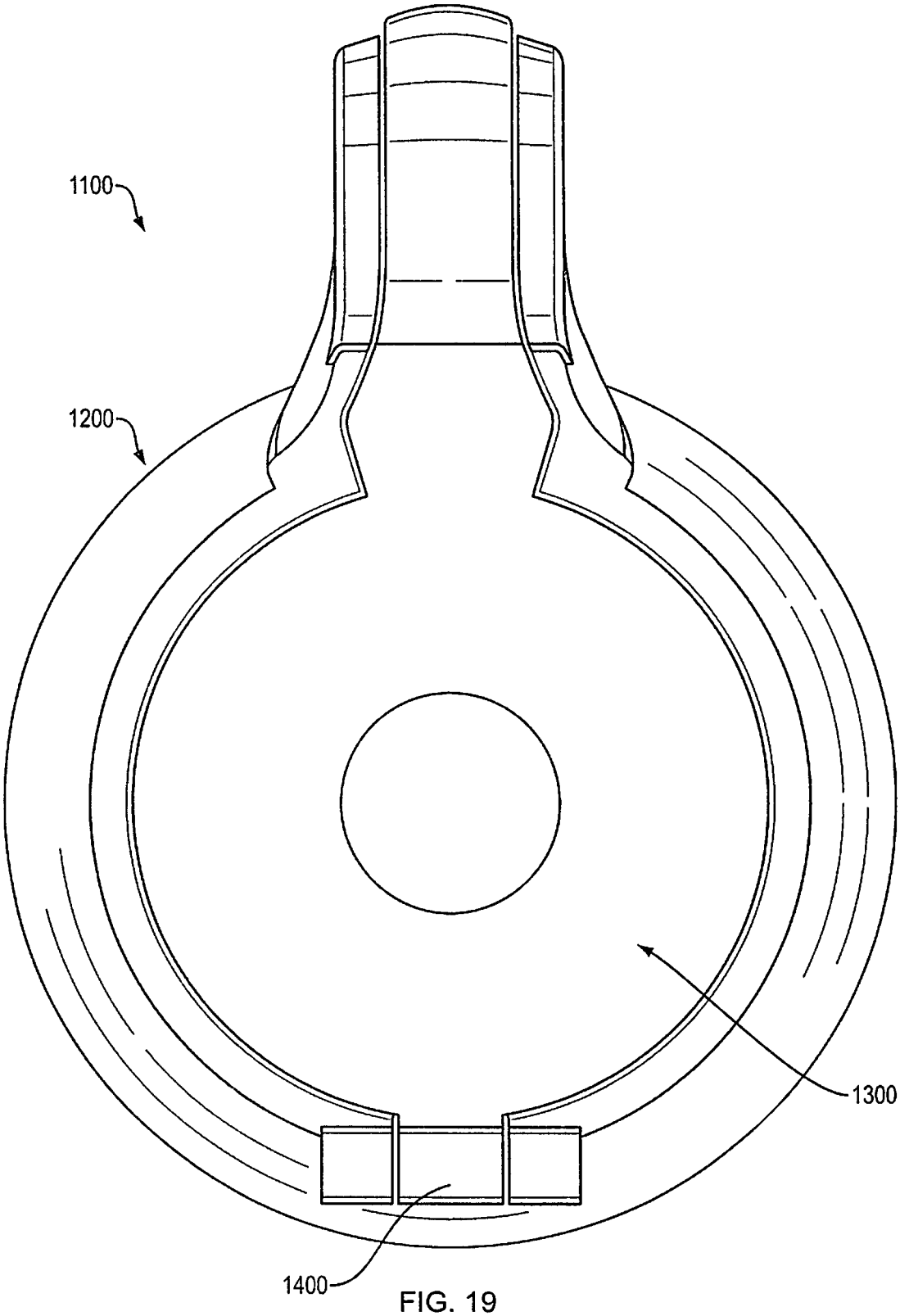
FIG. 19 is a back view of the jewelry piece of FIG. 17.

In an alternate embodiment, the channel may be empty. With reference to FIGS. 17-19, jewelry piece 1100 is substantially similar to jewelry piece 100, and comprises a body or housing 1200 and a cover or back 1300, which are coupled together by a hinge 1400. Both jewelry pieces 100 and 1100 accept an ornament 500 and 1500, respectively. The two jewelry pieces 100 and 1100 differ only in their respective body top surfaces, 210 and 1210, respectively. In jewelry piece 1100, the grove or channel 1216 is empty, and does not contain any decorative objects.

Figure 20:
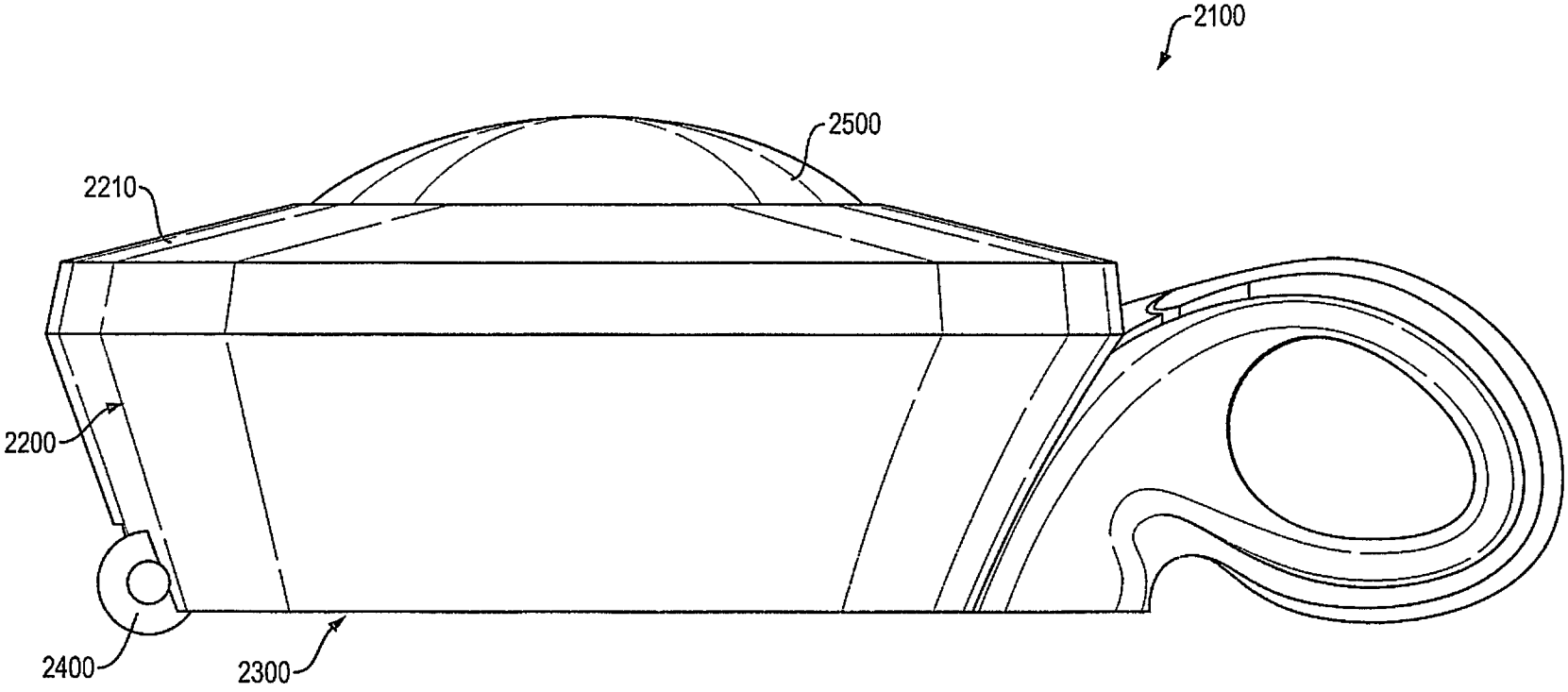
FIG. 20 is a perspective view of a jewelry piece, shown as a pendant, for an interchangeable ornament, in accordance with a second additional embodiment of the invention.

In an additional, alternate embodiment, the jewelry piece may not comprise a channel. With reference to FIG. 20, jewelry piece 2100 is substantially similar to jewelry piece 100, and comprises a body or housing 2200 and a cover or back 2300, which are coupled together by a hinge 2400. Both jewelry pieces 100 and 2100 accept an ornament 500 and 2500, respectively. The two jewelry pieces 100 and 2100 differ only in their respective body top surfaces, 210 and 2210, respectively. In jewelry piece 2100, the top surface 2210 does not comprise a channel, but instead defines an uninterrupted planar surface.

In all of these embodiments, the body top surfaces 210, 1210 and 2210 may optionally comprise other decorative treatments, including but not limited to etching or embossing, or adding decorative chains or stones.

With further reference to FIGS. 3, and 8-16, the cover 300 is substantially annular and comprises a top surface 310, a bottom surface 320, a contiguous sidewall 330 connecting the top surface 310 and the bottom surface 320, and a lip 340. The lip 340 is substantially perpendicular to the sidewall 330 and is adapted and configured to contact the bottom surface 220 of the body 200 when the jewelry piece 100 is closed.

Figure 3:
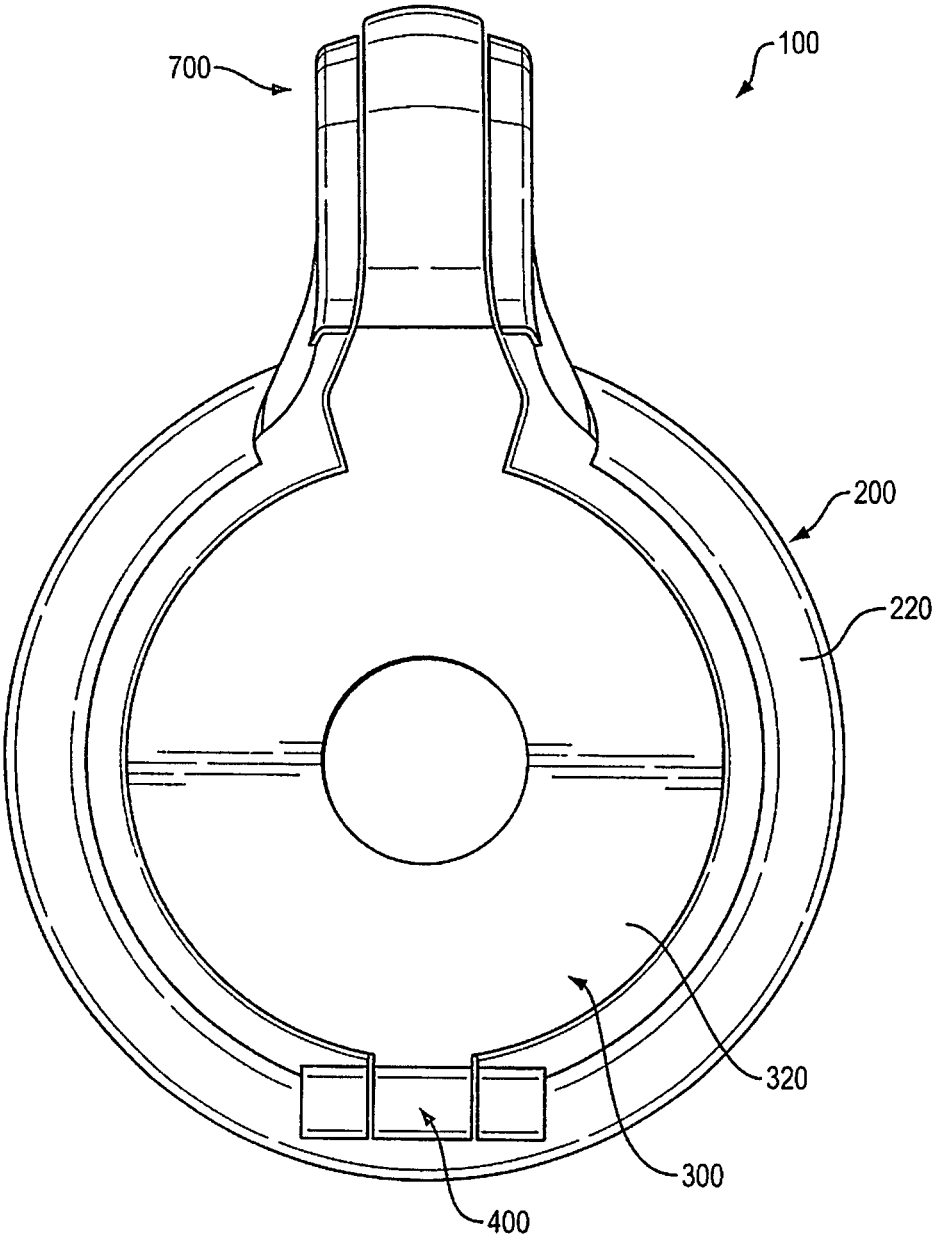
FIG. 3 is a back view of the jewelry piece of FIG. 1.
Figure 4:
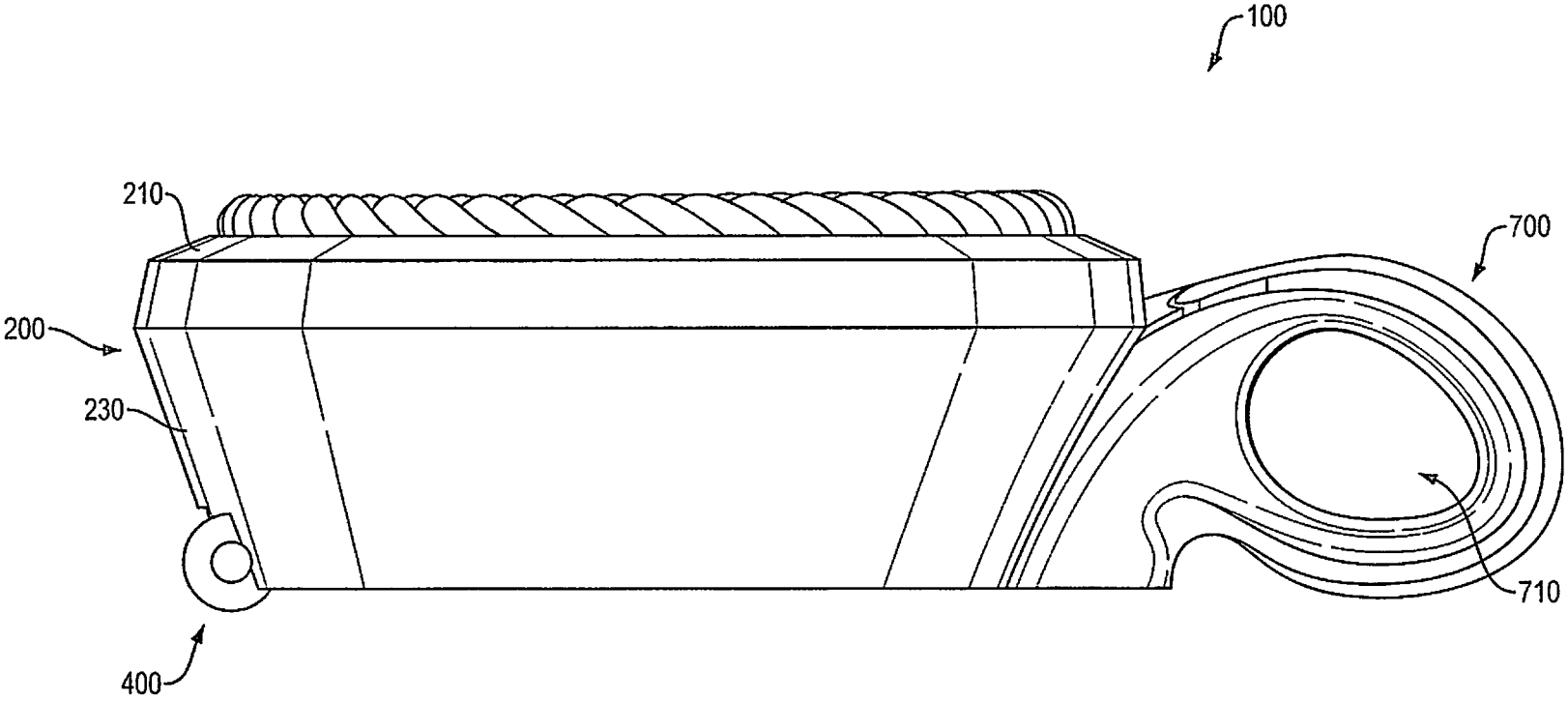
FIG. 4 is a side view of the jewelry piece of FIG. 1.
Figure 5:
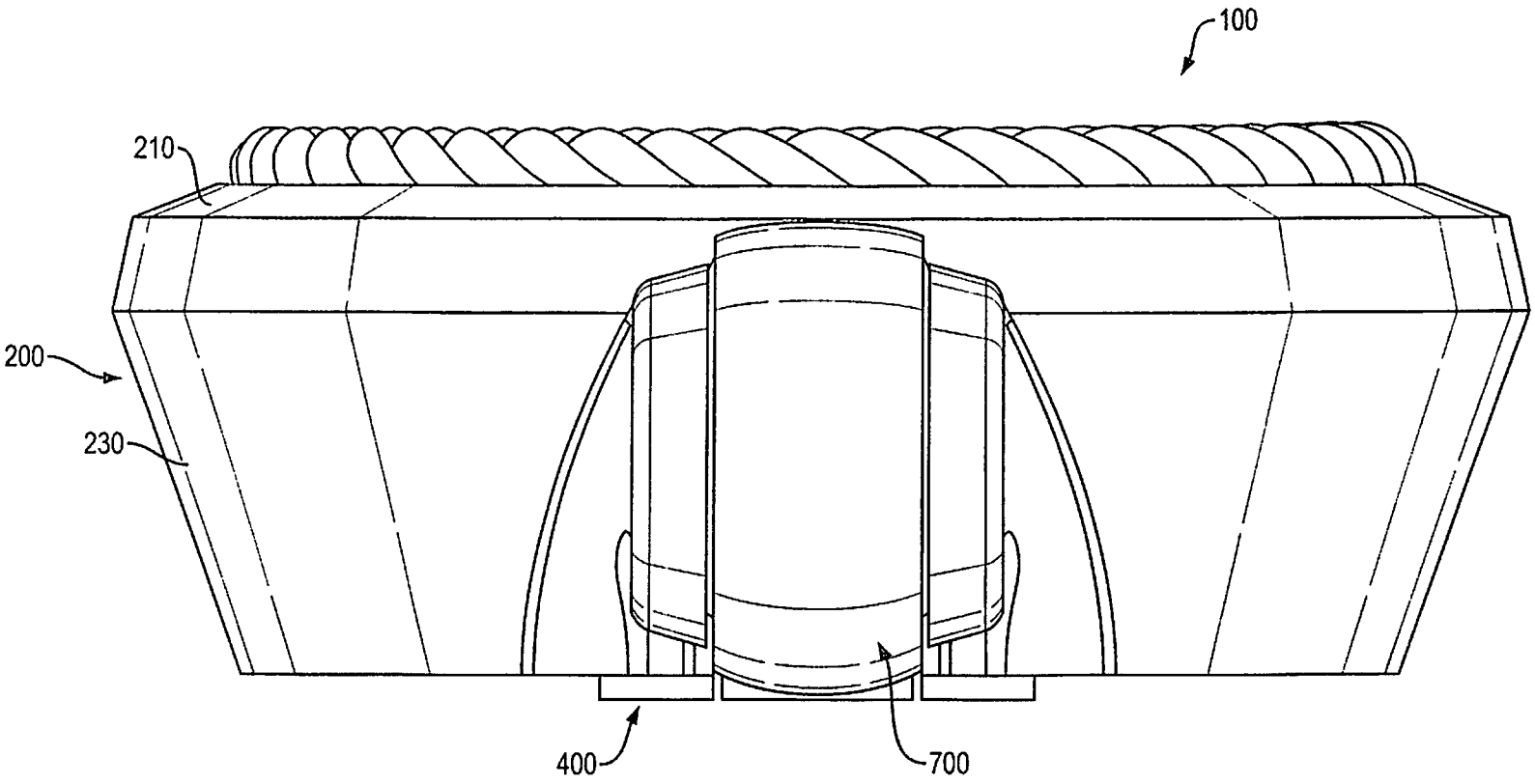
FIG. 5 is a top view of the jewelry piece of FIG. 1.

With further reference to FIGS. 1-4, cover 300 is preferably adapted and configured such that it is not visible when the jewelry piece 100 is viewed from the front or the side, to minimize exterior evidence of the interchangeability of the ornament 500. In a preferred embodiment, and as shown in FIG. 3, cover bottom surface 320 has a circumference that is smaller than the circumference of body bottom surface 220.

Figure 8:
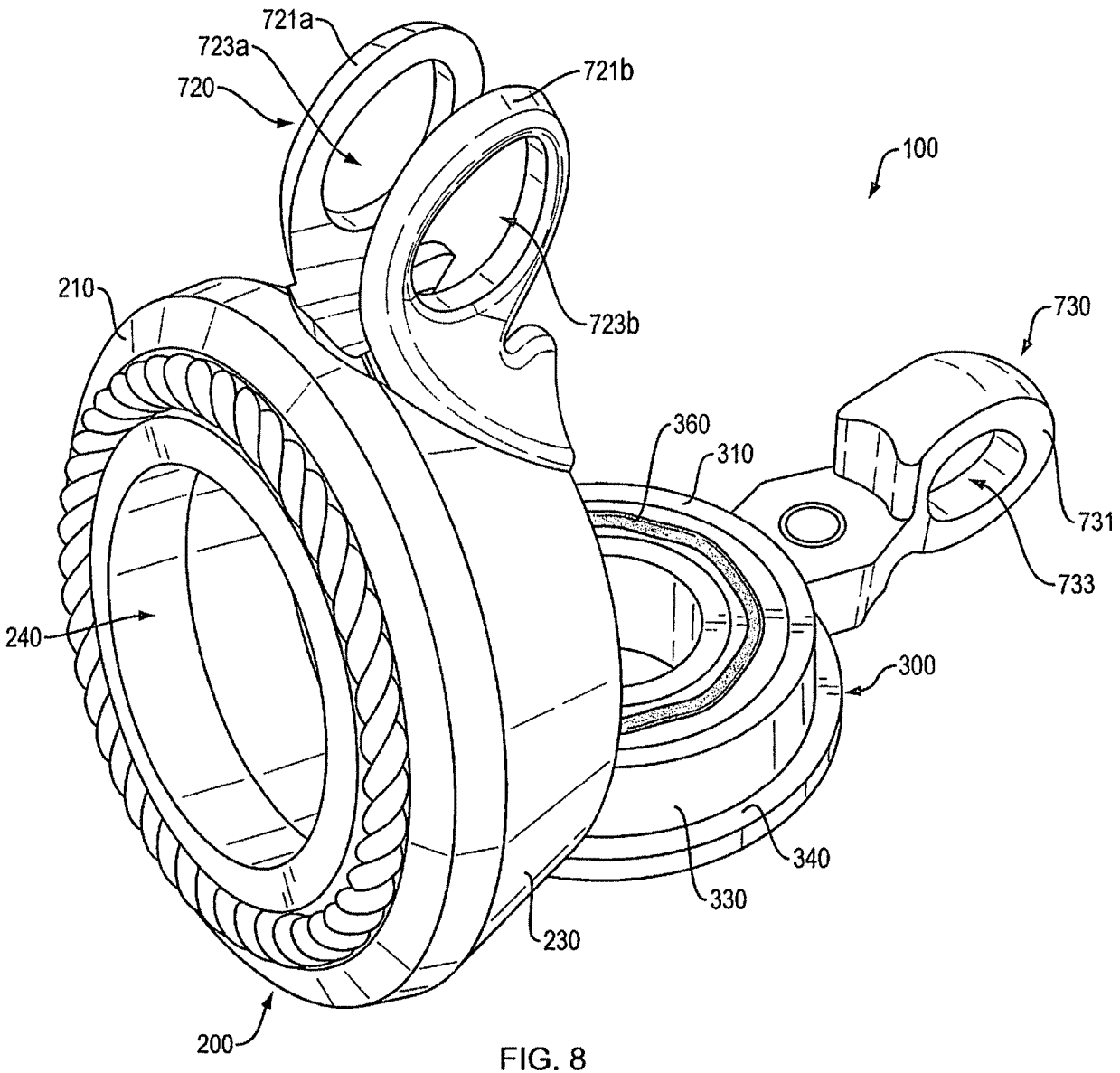
FIG. 8 is a perspective view of the jewelry piece for an interchangeable ornament of FIG. 1 in a partially open position, in accordance with a preferred embodiment of the invention.
Figure 9:
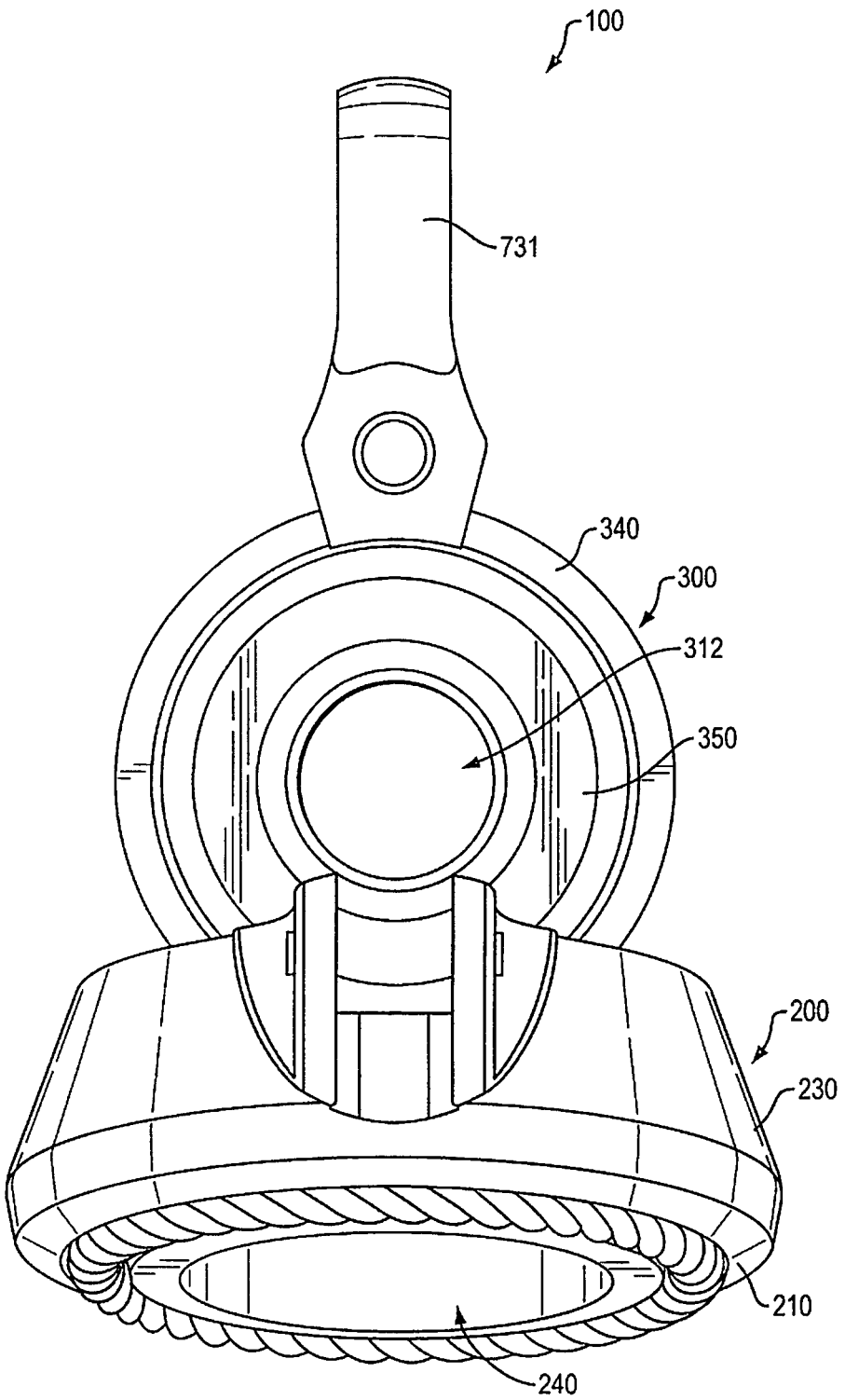
FIG. 9 is a front view of the jewelry piece of FIG. 8.
Figure 10:
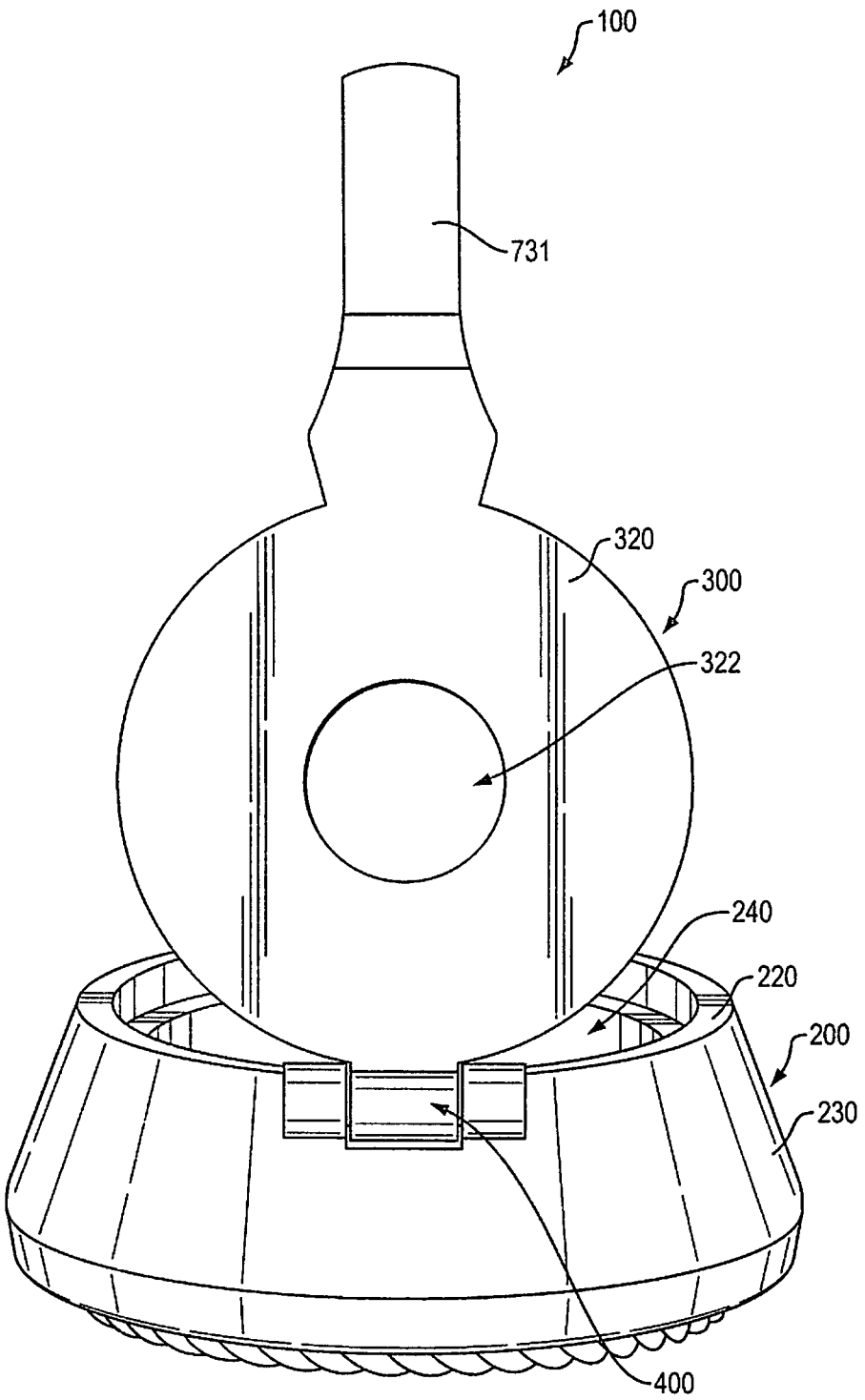
FIG. 10 is a back view of the jewelry piece of FIG. 8.
Figure 11:
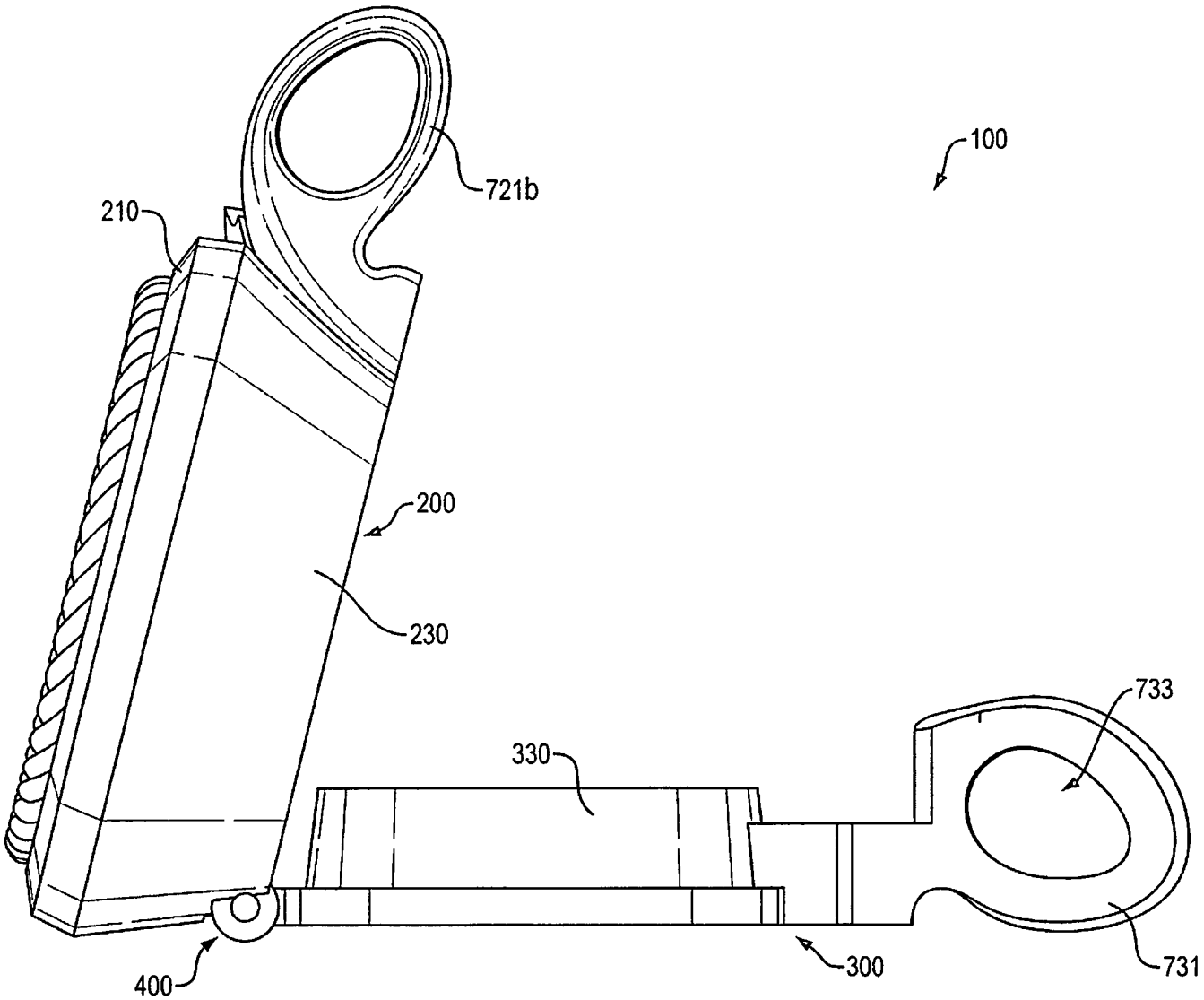
FIG. 11 is a side view of the jewelry piece of FIG. 8.
Figure 12:
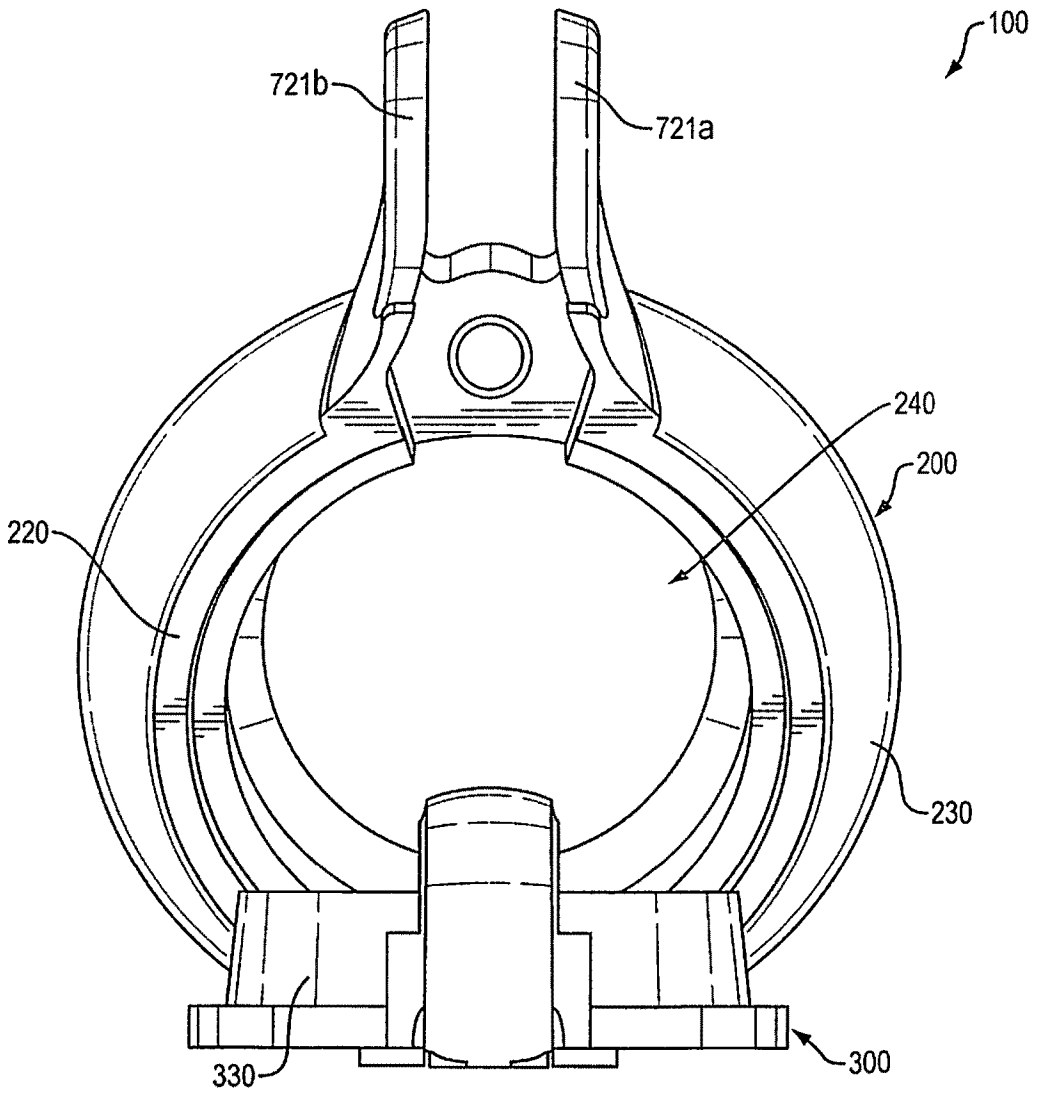
FIG. 12 is a top view of the jewelry piece of FIG. 8.

As shown in FIGS. 8 and 9, the top surface 310 of the cover 300 defines a first opening 312. As shown in FIG. 10, the bottom surface 320 of the cover 300 defines a second opening 322. The first opening 312 and the second opening 322 are adapted and configured to allow light to enter the body cavity 240. If the ornament 500 is sufficiently translucent, openings 312 and 322 are adapted and configured to allow light to pass through the ornament.

In alternate embodiments, the first opening 312 and the second opening 322, both in the cover 300, may be eliminated, and both the cover top surface 310 and the cover bottom surface 320 may be continuous planar surfaces. This alternate embodiment may be used, for example, when the ornament 500 is not sufficiently translucent to allow light to pass.

As shown in FIG. 9, the cover 300 further defines a groove or channel 350 that extends substantially circumferentially around the first opening 312 of the top surface 310. With further reference to FIG. 8, a support member 360 substantially fills the channel 350 and protrudes slightly above the horizontal plane of top surface 310. Support member 360 is adapted and configured to contact the bottom 520 of the ornament 500 when jewelry piece 100 is closed, and pushes the ornament 500 against the top surface rim 214 to secure the ornament 500 in the body cavity 240. Support member 360 is preferably made of silicone, to prevent scratching or otherwise damaging the ornament 500 and clear silicone is preferred for aesthetic reasons. In alternate embodiments, support member 360 may be made of any compressible material that functions to hold the ornament 500 in place, such as rubber.

Figure 13:
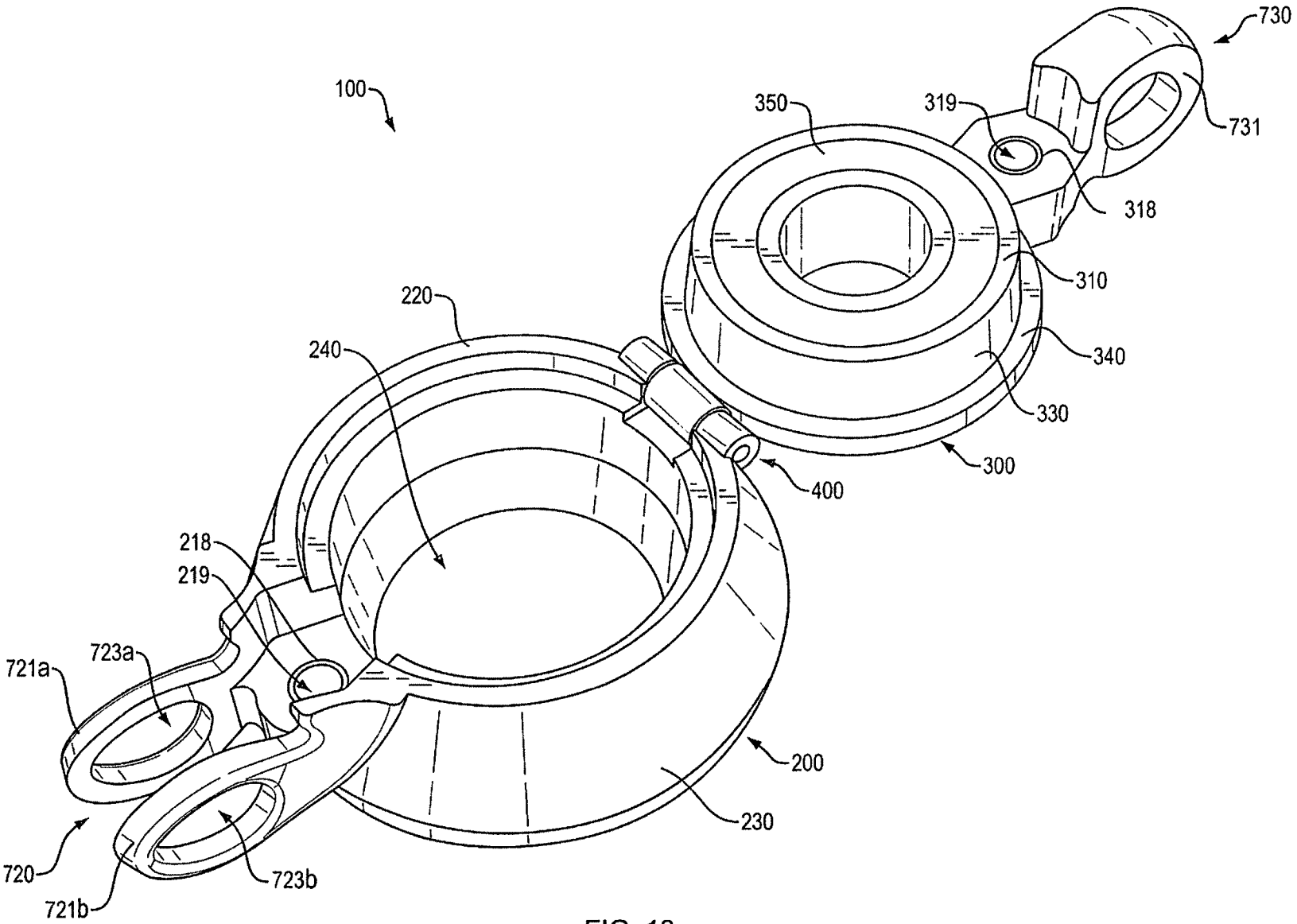
FIG. 13 is a perspective view of the jewelry piece for an interchangeable ornament of FIG. 1 in a fully open position, in accordance with a preferred embodiment of the invention.

Jewelry piece 100 comprises a magnetic closure that is adapted and configured to secure the ornament 500 in place when the jewelry piece 100 is closed. With further reference to FIGS. 13 and 14, the body 200 and the cover 300 each define a small cavity 218 and 318, respectively, each adapted to hold a magnet, 219 and 319, respectively, of opposite polarity and of substantially the same size and shape as the cavity. The magnets 219 and 319 are preferably permanently affixed, and not removable by the wearer of the jewelry piece 100. The two magnets 219 and 319 are located substantially directly opposite each other when the jewelry piece 100 is closed, preferably proximate the top of the jewelry piece 100. Cavities 218 and 318, and magnets 219 and 219, are not limited to a round shape, and may be substantially any shape.

When the cover 300 is closed against the body 200, the two magnets 219 and 319 engage and, by magnetic coupling, are adapted and configured to keep the jewelry piece 100 closed. The jewelry piece 100 is opened by pulling the cover 300 away from the body 200, thus releasing the magnets 219 and 319 from each other.

In a preferred embodiment, the magnets 219 and 319 are covered or encased to prevent rust and erosion. For example, the magnets 219 and 319 may be covered with nickel, copper, gold, silver, zinc, stainless steel, any other suitable metal, or a combination of these. In an alternate embodiment, there may be only one magnet, and the opposing cavity may contain a metal element that is attracted to a magnet, such as any metal that contains iron, cobalt, or nickel.

Note that the magnets 219 and 319 may be a ferrite magnet, an alnico magnet, a rare-earth neodymium magnet, a rare earth-samarium cobalt magnet, or a sintered neodymium-iron-boron compound, or other suitable magnets. The magnets 219 and 319 are preferably rare-earth neodymium magnets, which provide substantially powerful magnetic fields relative to their size.

The required dimensions and magnetic force for the magnets 219 and 319 depend on a number of variables, including the dimensions and weights of the jewelry piece and the pre-determined force necessary to uncouple the magnets by using only the user's fingers, and without the use of an additional tool. Determining the required dimensions and magnetic force for the magnets based on such variables falls within the ability of one having ordinary skill in the art.

With further reference to FIGS. 1-6, 8-16, and 21, jewelry piece 100 further comprises a bail 700, preferably located proximate the top of the jewelry piece 100 and longitudinally opposite the hinge 400.

Bail 700 comprises a body mating section 720 and a cover mating section 730. As shown in FIGS. 1, 8, 16 and 21, when the jewelry piece 100 is closed, the body mating section 720 and the cover mating section 730 mechanically engage to form bail 700 and define an opening 710 that is adapted and configured to allow a chain or cord 800 to be inserted, to form a pendant necklace 3000. The jewelry piece may be opened, and the ornament replaced, only if the chain or cord 800 has been removed from the opening 710. Jewelry piece 100 may be opened by pulling back on the bail cover mating element 731, described below, while holding the jewelry piece body 200.

Figure 22:
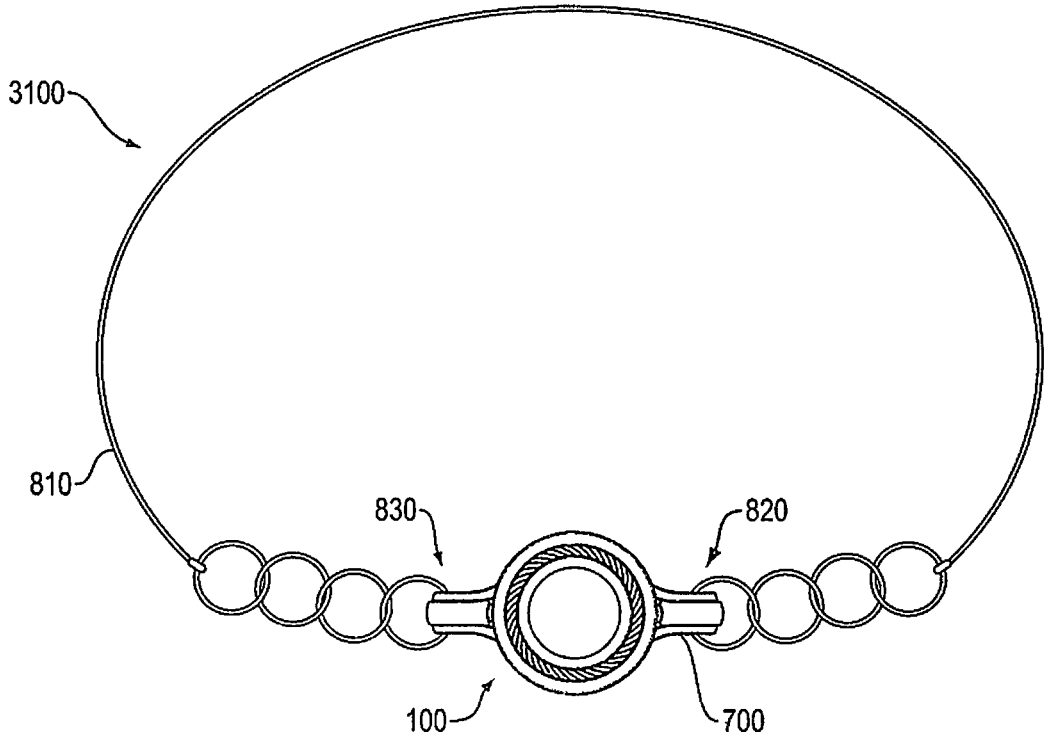
FIG. 22 is a perspective view of a jewelry piece, shown as a necklace, for an interchangeable ornament, in accordance with a fourth additional embodiment of the invention.
Figure 23:
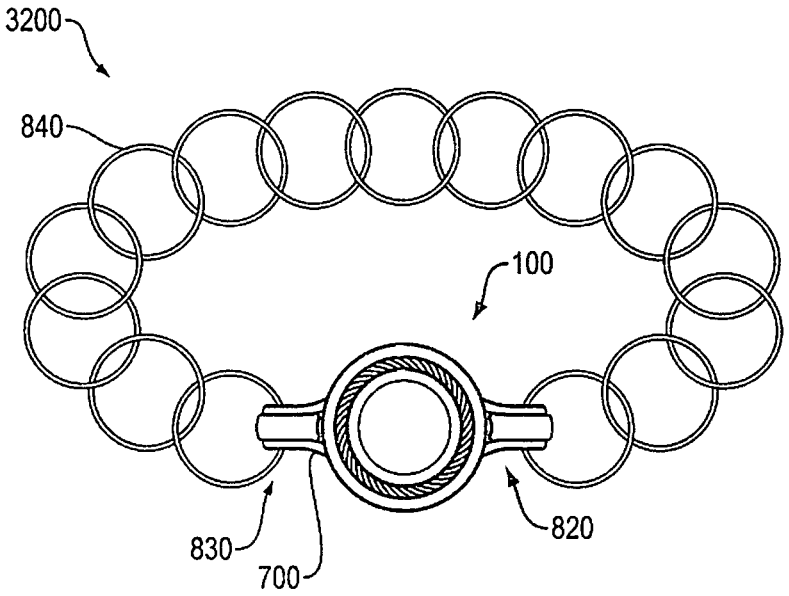
FIG. 23 is a perspective view of a jewelry piece, shown as a bracelet, for an interchangeable ornament, in accordance with a fifth additional embodiment of the invention.

In an alternate embodiment, and as shown in FIG. 22, jewelry piece 100 may be used with a chain, cord, or string of beads or other decorative elements 810, all of which may be comprised of any suitable material, to form a necklace 3100. In this embodiment, a clasp 820, such as a lobster clasp, toggle clasp, or spring ring clasp, may be used to removably couple chain or cord 810 to bail 700. The jewelry piece may be opened, and the ornament replaced, only when the clasp 820 is decoupled from the bail 700. The distal end of the jewelry piece may include a second bail 830 that is permanently affixed to the opposing end of the chain 810. This second bail 830 does not open. In a similar, additional embodiment, and as shown in FIG. 23, a short chain or cord 840 may be used with jewelry piece 100, clasp 820, or any other suitable materials, and second bail 830 to form a bracelet 3200. As with the pendant necklace 3100 shown in FIG. 22, the second bail 830 of bracelet 3200 does not open.

Figure 24:
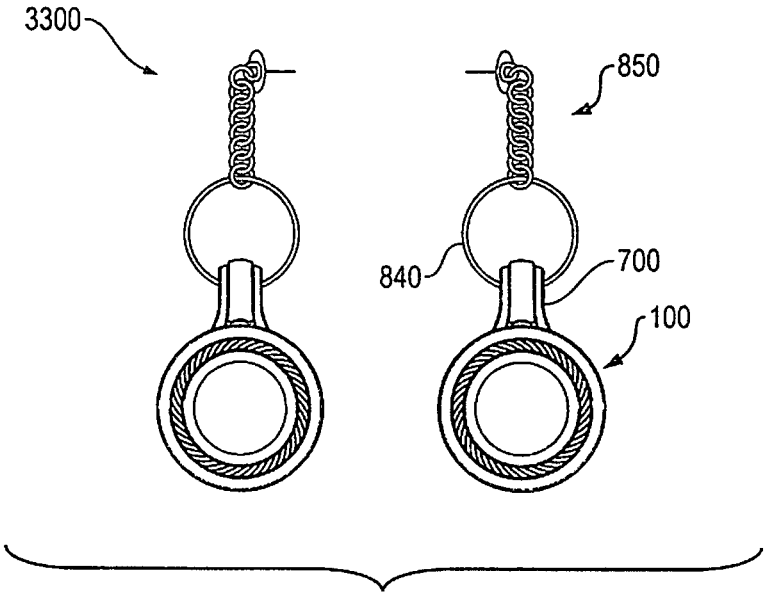
FIG. 24 is a perspective view of a jewelry piece, shown as earrings, for an interchangeable ornament, in accordance with a sixth additional embodiment of the invention.

In an additional embodiment, and as shown in FIG. 24, jewelry piece 100 may be used with a clip 840 to form earrings 3300. In this embodiment, any suitable securing mechanism, including but not limited to a clip or clasp 840, may be used to removably couple bail 700 from an earring mechanism 850. The jewelry piece may be opened, and the ornament replaced, only when the clip 840 is decoupled form the bail 700.

As shown in FIGS. 8-11, cover mating section 730 is preferably integral to the cover 300 and comprises a single mating element 731. Cover mating section 730 also defines an opening 733.

As shown in FIGS. 8 and 11-16, body mating section 720 is preferably integral to the body 200, and comprises two substantially identical mating elements 721*a* and 721*b*. Body mating elements 721*a* and 721*b* each define an opening 723*a* and 723*b*, respectively. In a preferred embodiment, mating elements 721*a* and 721*b* are spaced apart and substantially parallel to one another, such that openings 723*a* and 723*b* are in alignment In a preferred embodiment, the mating elements 721*a*, 721*b*, and 731 are loops or rings having a substantially oval or circular shape. In alternate embodiments, mating elements 721*a*, 721*b*, and 733 may have any substantially contiguous shape. In a preferred embodiment, openings 723*a*, 723*b*, and 733 define a substantially oval or circular shape. In alternate embodiments, openings 723*a*, 723*b*, and 733 may define any substantially contiguous shape.

Figure 21:
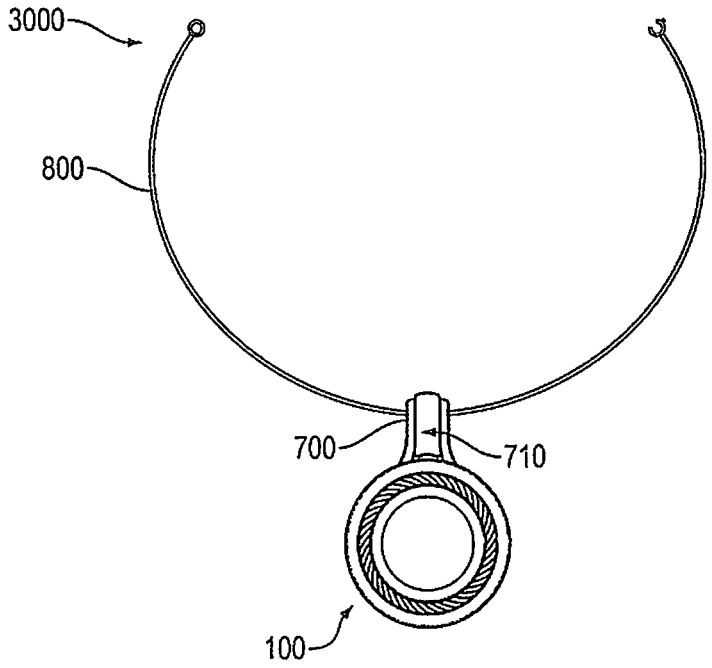
FIG. 21 is a perspective view of a jewelry piece, shown as a pendant, for an interchangeable ornament, in accordance with a third additional embodiment of the invention.

As shown in FIGS. 8 and 12-15, the space or opening between the body mating elements 721*a* and 721*b* is sized and shaped to accommodate the cover mating element 731. As shown in FIG. 1, when the jewelry piece 100 is closed, the cover mating element 731 is inserted into the space or opening between the body mating elements 721*a* and 721*b*, thus interlocking to form bail 700. Further, when the jewelry piece 100 is closed, openings 723*a*, 723*b*, and 733 together form bail opening 710. As shown in FIG. 21, bail opening 710 is adapted and configured to allow a chain or cord 800 to be inserted through it.

The combination of the magnets 219 and 319, and the bail 700, are adapted and configured to provide two levels of security for jewelry piece 100, to prevent jewelry piece 100 from opening and thus prevent the ornament 500 from falling out.

In an additional preferred embodiment, the bail may further include a tab or protrusion to facilitate opening the jewelry piece and/or a covering or facing to provide additional structural support. With reference to FIGS. 25-29, jewelry piece 4100 is substantially similar to jewelry piece 100 and comprises a body or housing 4200 and a cover or back 4300, which are coupled together by hinge 4400. Both jewelry pieces 100 and 4100 are adapted and configured to accept an ornament, as described above. The two jewelry pieces 100 and 4100 differ only in their respective bails, 700 and 4700, respectively.

In jewelry piece 4100, bail 4700 comprises a body mating section 4720 and a cover mating section 4730. When the jewelry piece 4100 is closed, the body mating section 4720 and the cover mating section 4730 mechanically engage to form bail 4700 and define an opening 4710 to allow a chain or cord to be inserted through it. As with bail 700, bail 4700 is preferably located proximate the top of the jewelry piece 4100 and longitudinally opposite the hinge 4400.

Figure 25:
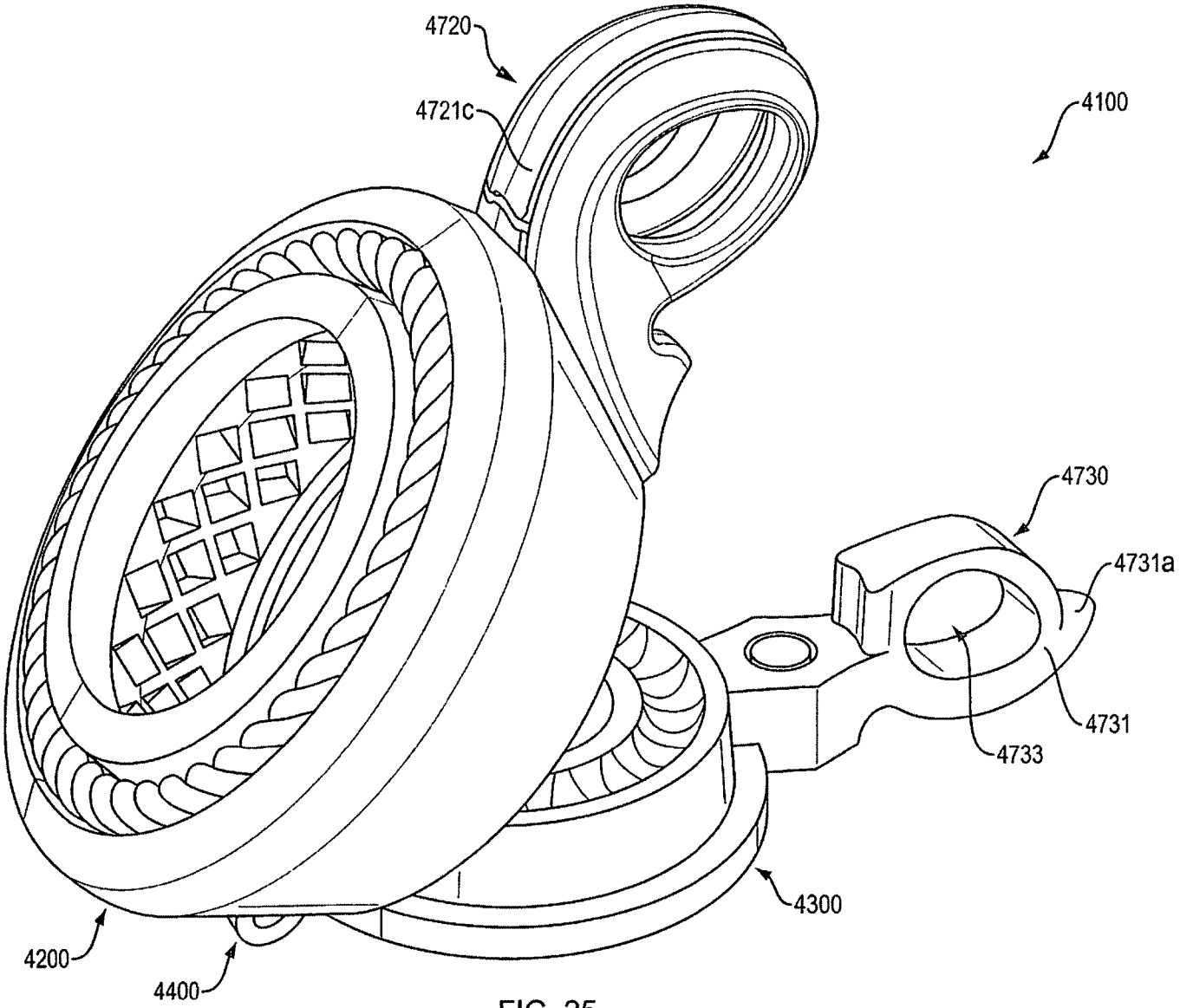
FIG. 25 is a perspective view of a jewelry piece for an interchangeable ornament in a partially open position, in accordance with a seventh additional embodiment of the invention.
Figure 26:
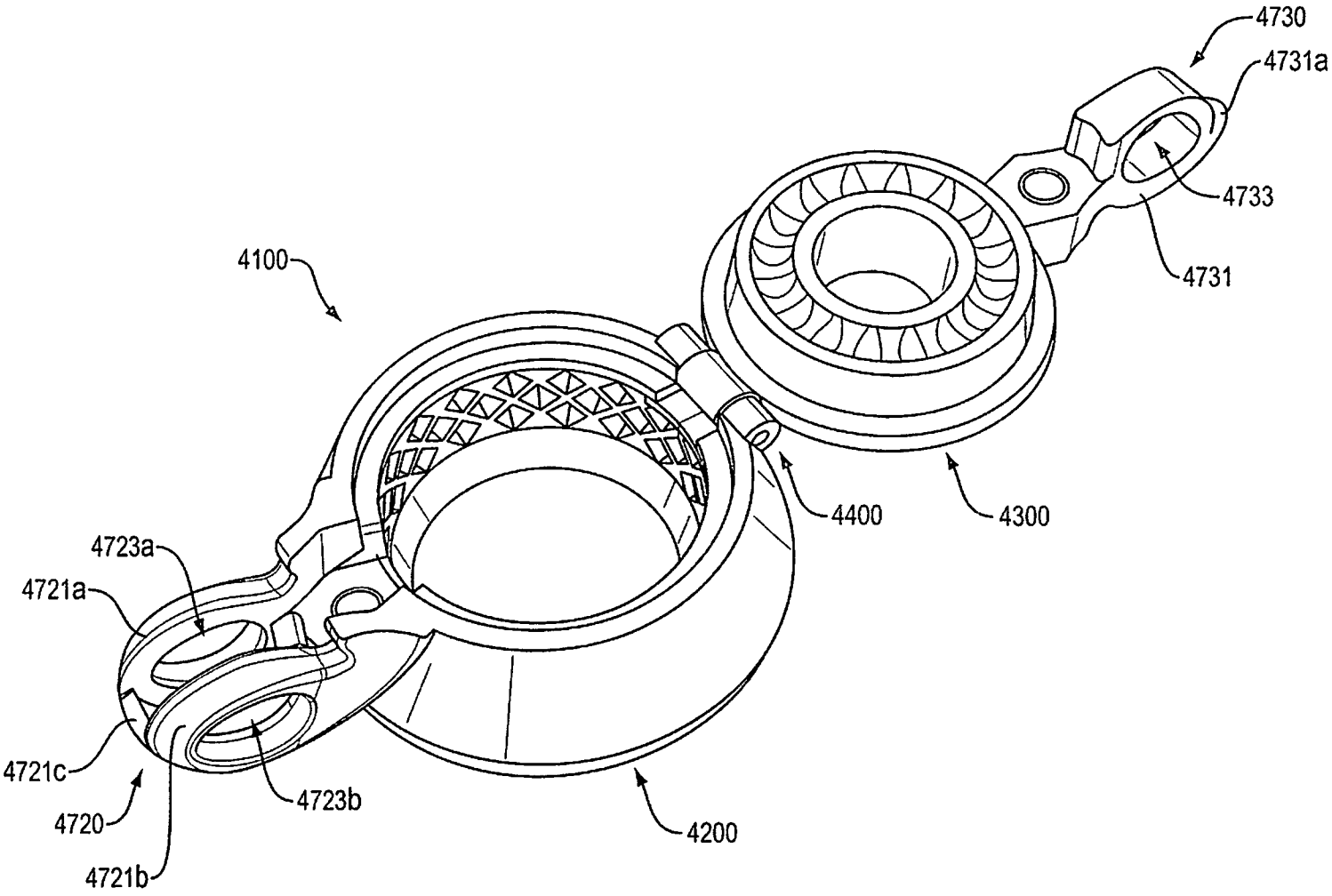
FIG. 26 is a perspective view of the jewelry piece of FIG. 25 in a fully open position.
Figure 27:
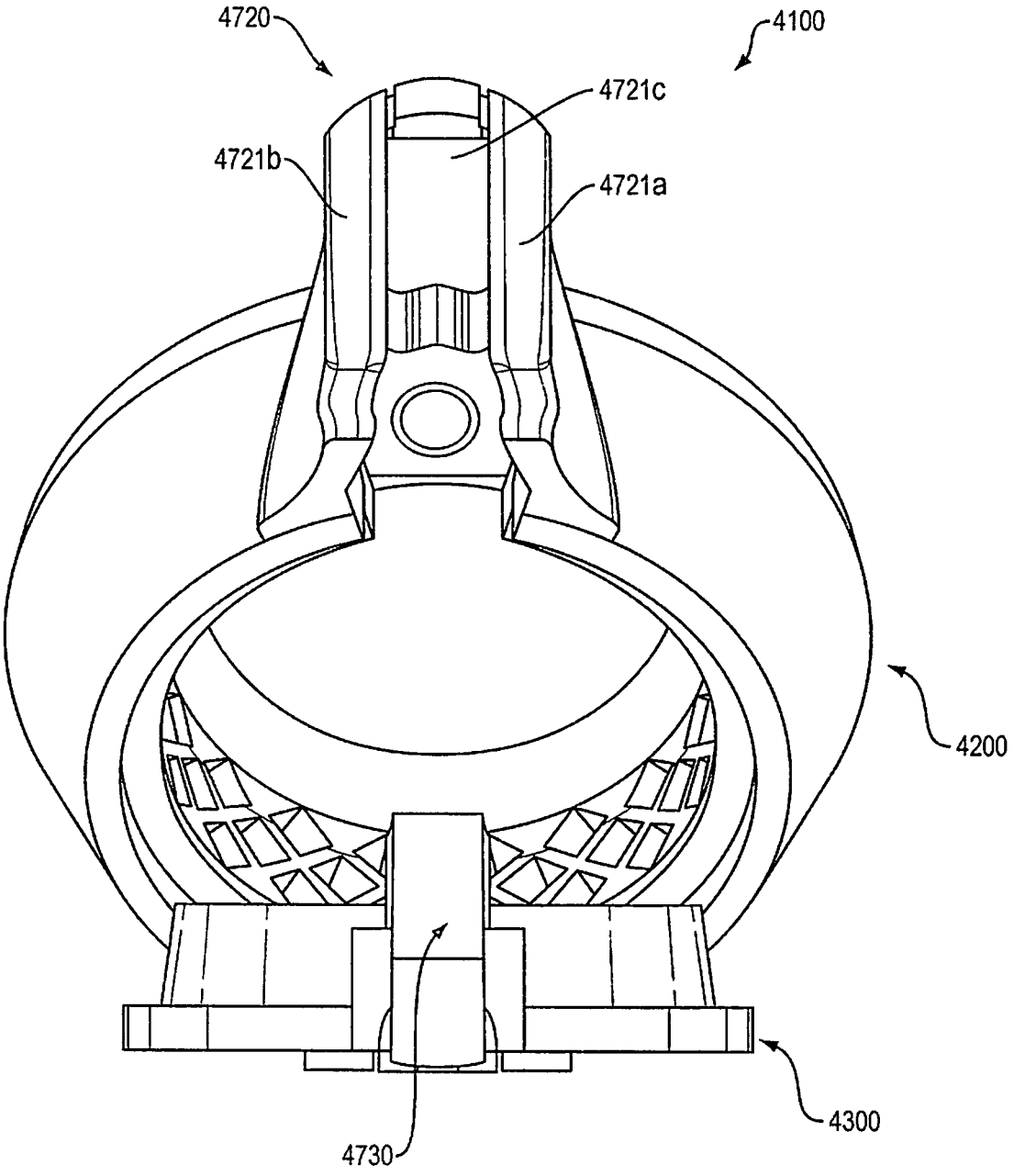
FIG. 27 is a top view of the jewelry piece of FIG. 25 in a partially open position.
Figure 28:
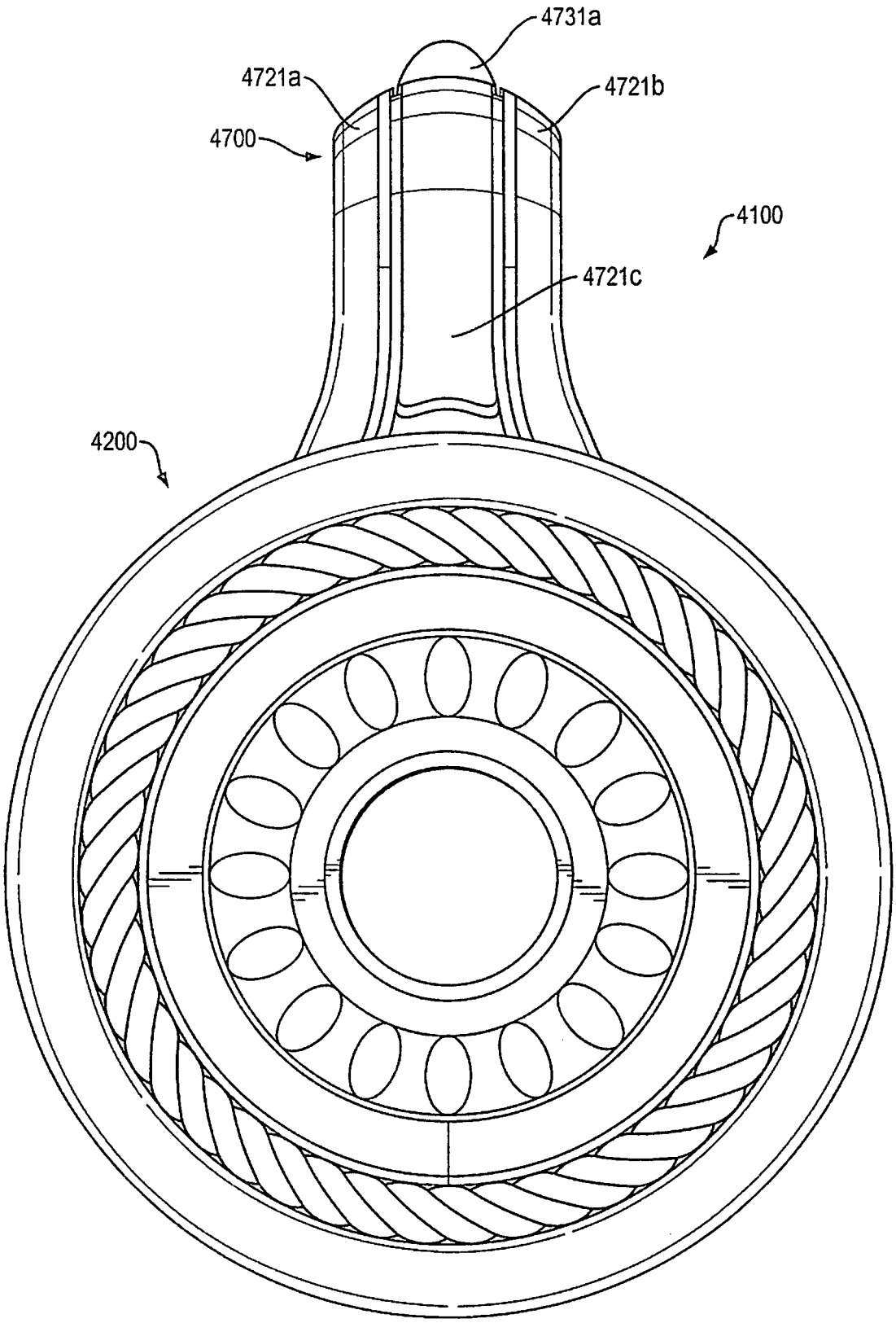
FIG. 28 is a front view of the jewelry piece of FIG. 25 in a closed position.
Figure 29:
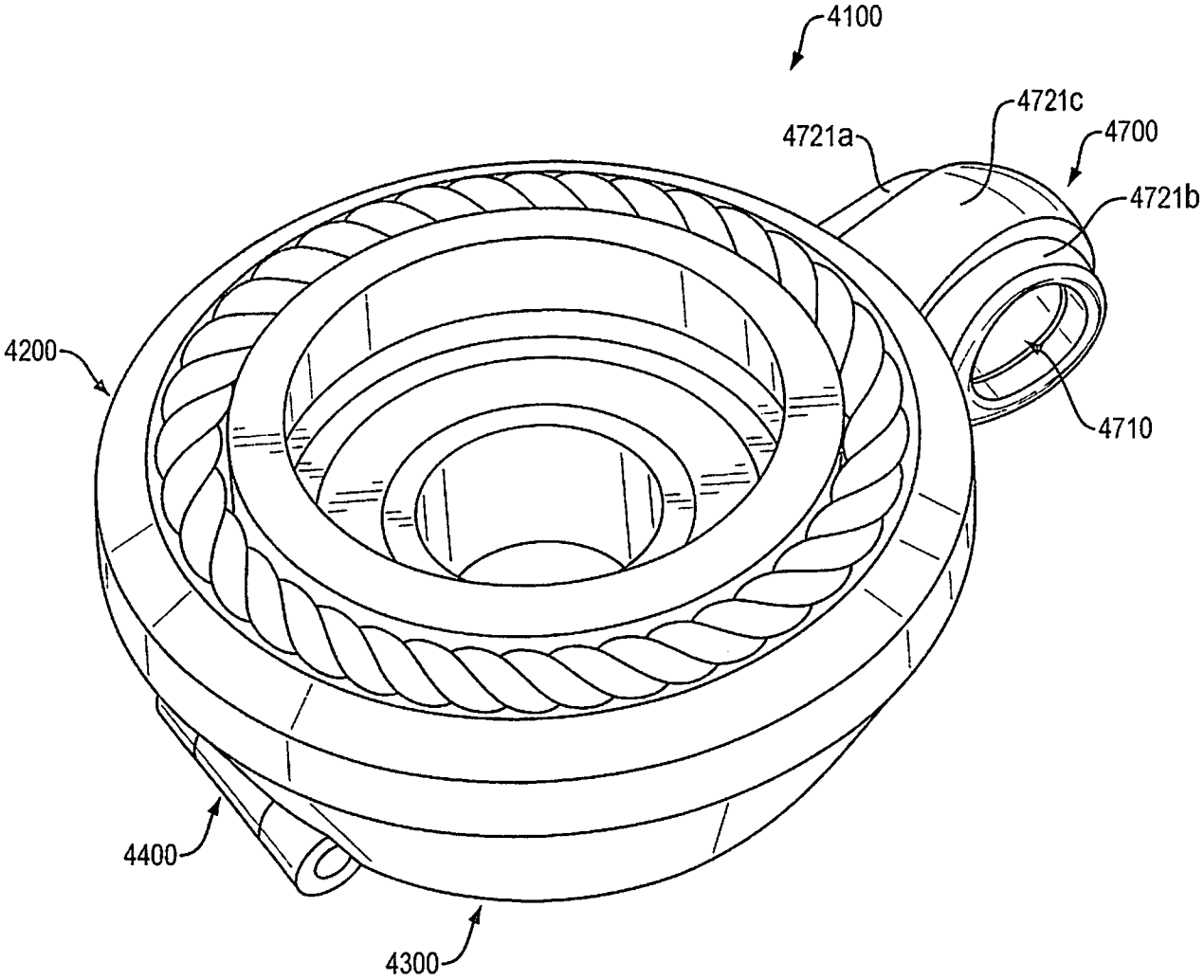
FIG. 29 is a perspective view of the jewelry piece of FIG. 25 in a closed position.

As shown in FIGS. 25, 26 and 28, cover mating section 4730 is preferably integral to the cover 4300 and comprises a single mating element 4731. Cover mating section 4730 also defines an opening 4733 and a protrusion or tab 4731*a*, which is preferably located proximate the top of jewelry piece 4100. Jewelry piece 4100 may be opened by pulling back on the protrusion or tab 4731*a*, while holding the jewelry piece body 4200.

With further reference to FIGS. 25-28, body mating section 4720 is preferably integral to the body 4200. Body mating section 4720 comprises two substantially identical mating elements 4721*a* and 4721*b* and a covering or facing 4721*c*. Body mating elements 4721*a* and 4721*b* each define an opening 4723*a* and 4723*b*, respectively. In a preferred embodiment, mating elements 4721*a* and 4721*b* are spaced apart and substantially parallel to one another, such that openings 4723*a* and 4723*b* are in alignment. Covering or facing 4721*c* is located between, and preferably integral with, mating elements 4721*a* and 4721*b*.

In a preferred embodiment, the mating elements 4721*a*, 4721*b*, and 4731 are loops or rings having a substantially oval or circular shape. In alternate embodiments, mating elements 4721*a*, 4721*b*, and 4731 may have any substantially contiguous shape. In a preferred embodiment, openings 4723*a*, 4723*b*, and 4733 define a substantially oval or circular shape. In alternate embodiments, openings 4723*a*, 4723*b*, and 4733 may define any substantially contiguous shape.

With further reference to FIGS. 25 and 26, the space or opening defined by body mating elements 4721*a* and 4721*b* and covering or facing 4721*c* is sized and shaped to accommodate the cover mating element 4731. When the jewelry piece 4100 is closed, the cover mating element 4731 is inserted into the space or opening defined by the body mating elements 4721*a* and 4721*b* and the covering or facing 4721*c*, thus interlocking to form bail 4700. In a preferred embodiment, cover mating element 4731 is not visible from the front of jewelry piece 4100 when jewelry piece 4100 is closed, as it is obscured by covering or facing 4721*c*. Covering or facing 4721*c* also functions to provide structural support for body mating elements 4721*a* and 4721*b*.

In a preferred embodiment, body mating elements 4721*a* and 4721*b* and covering or facing 4721*c* are manufactured as a single component, but this is not a limitation of the invention. In additional embodiments, covering or facing 4721*c* may be manufactured as a separate component and added or removed as needed.

The use of a second bail is further shown in FIGS. 30-38. In this additional embodiment, and as shown in FIGS. 30-33, jewelry piece 5100 is similar to jewelry pieces 100 and 4100 in that jewelry piece 5100 comprises a body or housing 5200 and a cover or back 5300, which are coupled together by hinge 5400. As with jewelry pieces 100 and 4100, jewelry piece 5100 is configured to accept an ornament 5500, similar to ornament 500, as described above. Jewelry piece 5100 further comprises a first bail 5700, which may be substantially the same as bail 700 of jewelry piece 100 or substantially the same as bail 4700 of jewelry piece 4100.

As with bail 700 and bail 4700, and as shown in FIGS. 32 and FIGS. 34-36, first bail 5700 is preferably located proximate the top of jewelry piece 5100 and longitudinally opposite hinge 5400, and comprises a first bail body mating section 5720 and a first bail cover mating section 5730. When the jewelry piece 5100 is closed, the first bail body mating section 5720 and the first bail cover mating section 5730 mechanically engage to form first bail 5700 and define a first bail opening 5710 that is adapted and configured to allow a chain or cord to be inserted.

First bail cover mating section 5730 is preferably integral to the cover 5300 and comprises a single first bail cover mating element 5731. First bail cover mating section 5730 also defines an opening 5733. First bail cover mating section 5730 may also comprise a protrusion or tab 5731*a* that is preferably substantially similar to the tab 4731*a* of jewelry piece 4100.

First bail body mating section 5720 is preferably integral to the body 5200, and comprises two substantially identical first bail body mating elements 5721*a* and 5721*b*. First bail body mating elements 5721*a* and 5721*b* each define an opening 5723*a* and 5723*b*, respectively. In a preferred embodiment, first bail body mating elements 5721*a* and 5721*b* are spaced apart and substantially parallel to one another, such that first bail body openings 5723*a* and 5723*b* are in alignment.

As with jewelry piece 100 and jewelry piece 4100, first bail body mating elements 5721*a*, 5721*b*, and first bail cover mating element 5731 are loops or rings having a substantially oval or circular shape. In alternate embodiments, first bail body mating elements 5721*a*, 5721*b*, and first bail cover mating element 5731 may have any substantially contiguous shape. In a preferred embodiment, first bail body openings 5723*a*, 5723*b*, and first bail cover opening 5733 define a substantially oval or circular shape. In alternate embodiments, first bail body openings 5723*a*, 5723*b*, and first bail cover opening 5733 may define any substantially contiguous shape.

Figure 34:
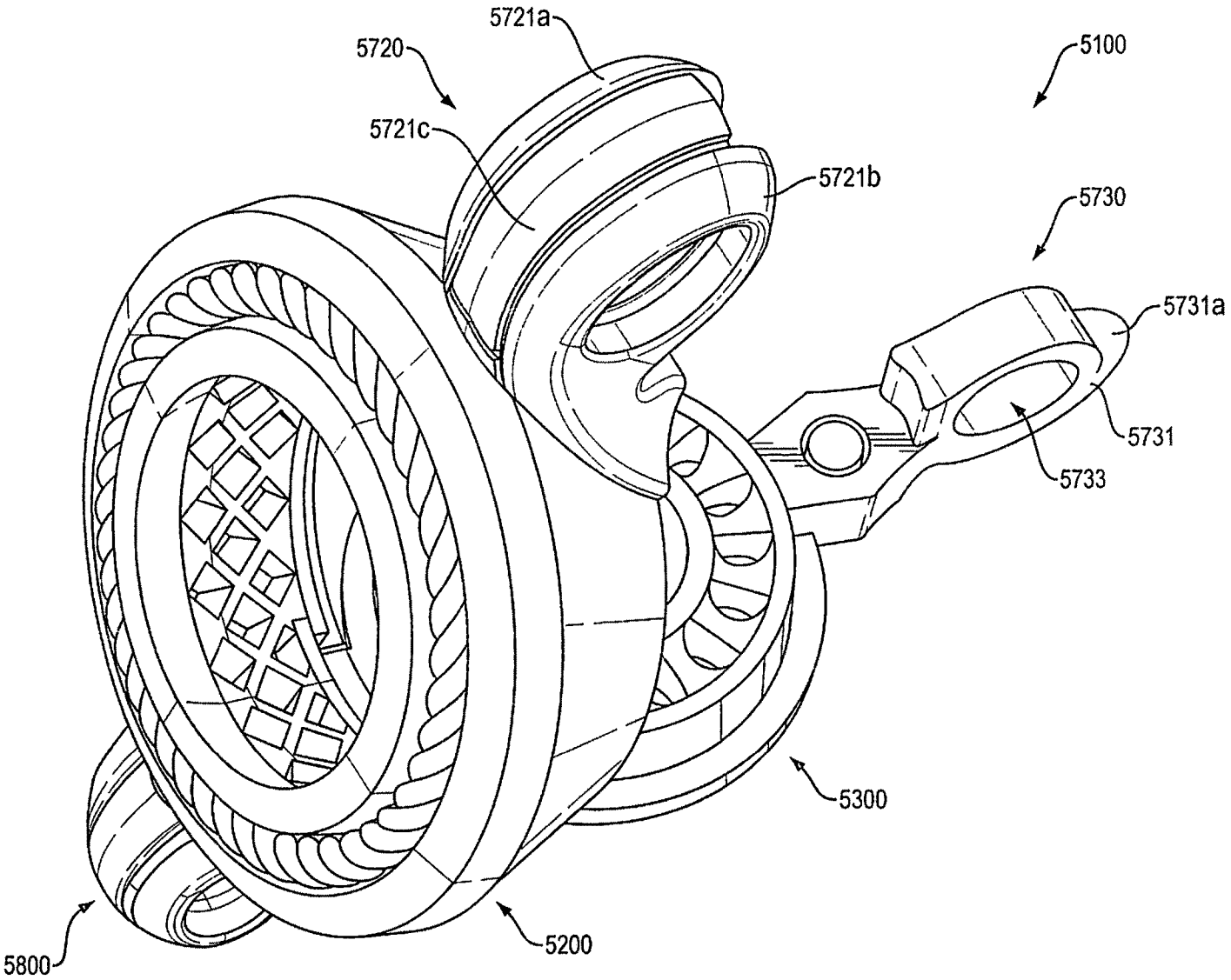
FIG. 34 is a front perspective view of the jewelry piece of FIG. 30 in a partially open position, in accordance with a preferred embodiment of the invention.
Figure 35:
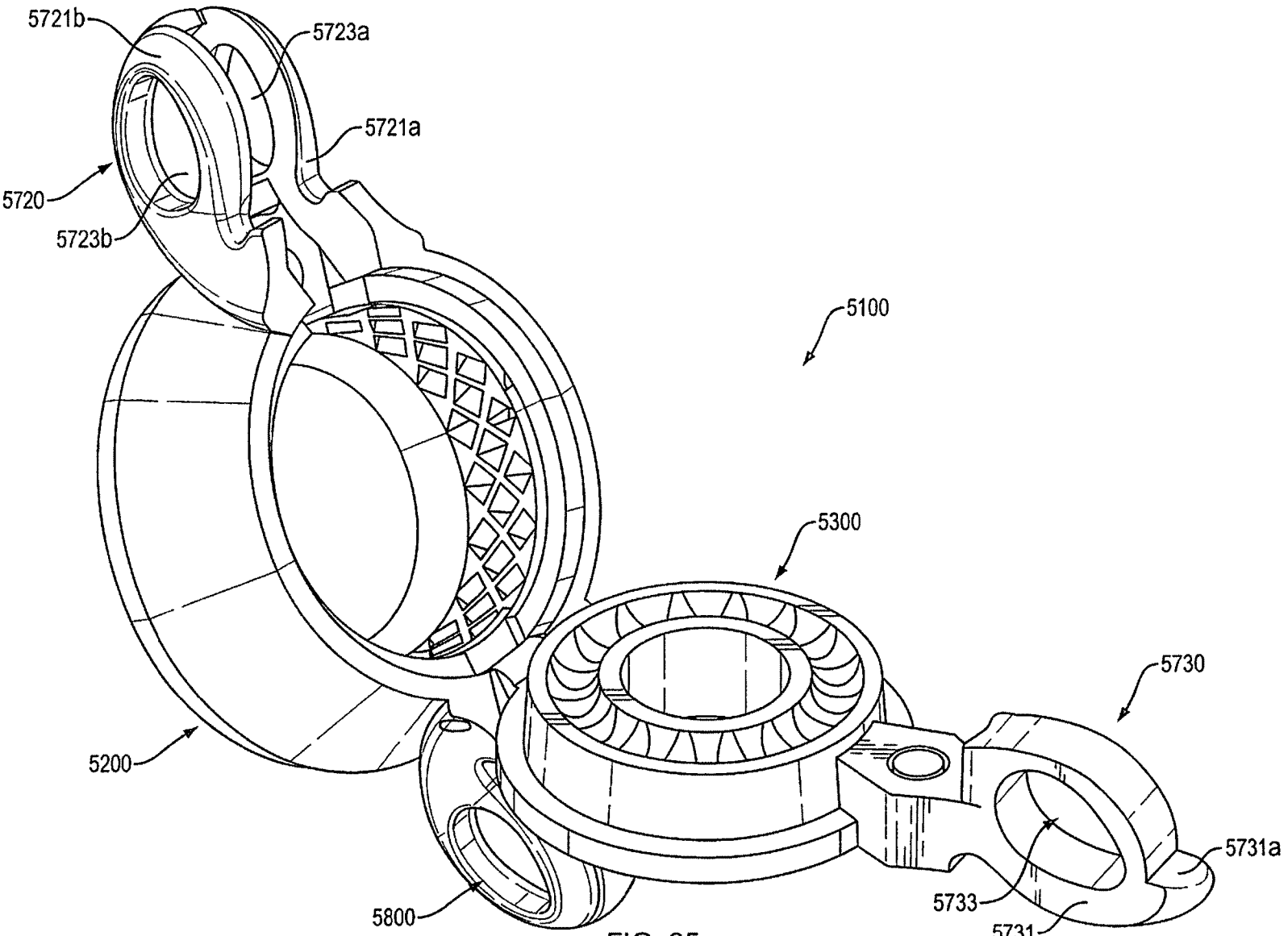
FIG. 35 is rear perspective view of the jewelry piece of FIG. 30.
Figure 36:
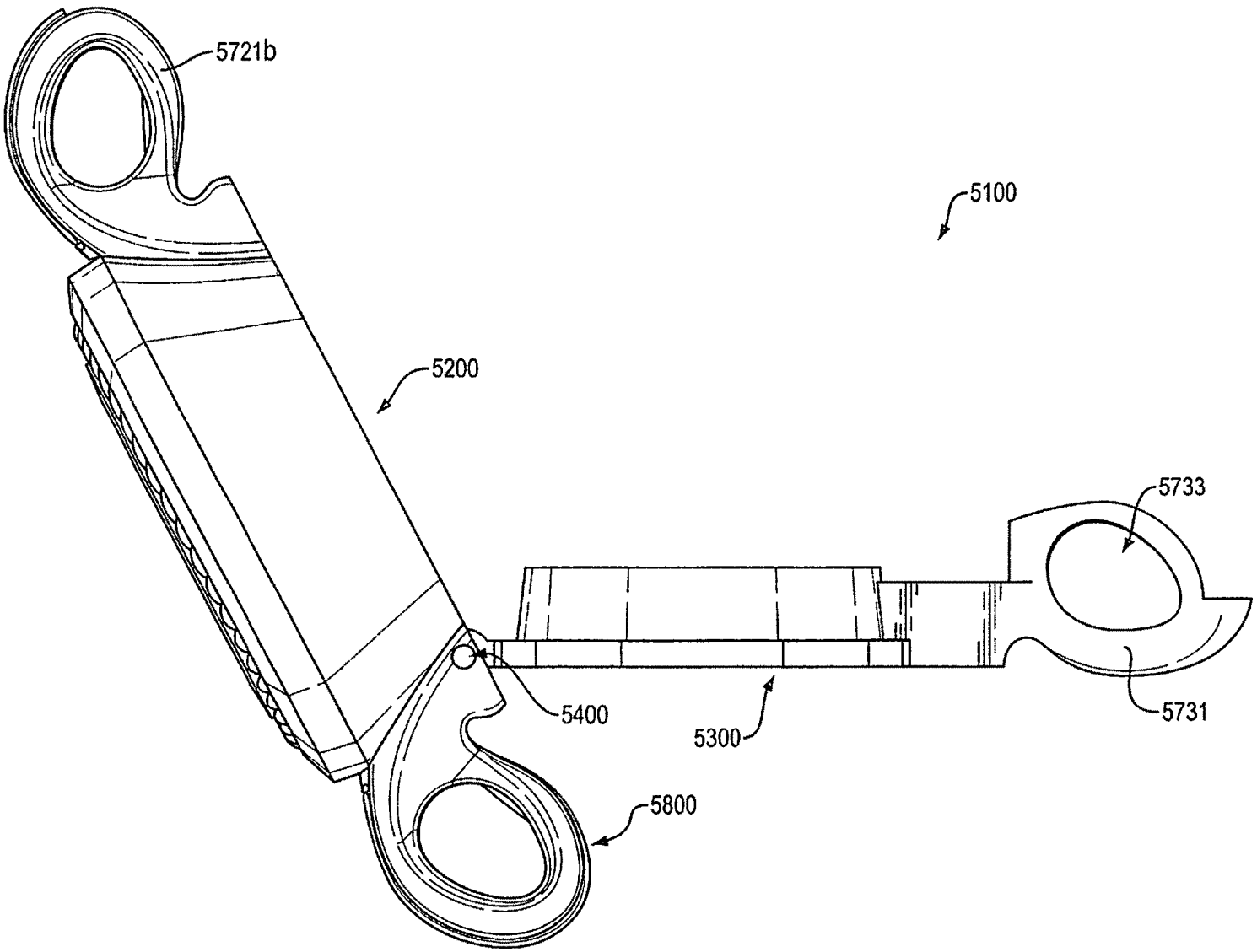
FIG. 36 is a side view of the jewelry piece of FIG. 30.

As with jewelry piece 4100, and as shown in FIG. 34, first bail body mating section 5720 may also comprise a first bail covering or casing 5721*c* located between, and preferably integral to, first bail body mating elements 5721*a* and 5721*b*. In this embodiment, first bail cover mating element 5731 is not visible from the front of jewelry piece 5100 when jewelry piece 5100 is closed, as it is obscured by first bail covering 5721*c*. First bail covering 5721*c* also functions to provide structural support for first bail body mating elements 5721*a* and 5721*b*.

As with jewelry piece 100 and jewelry piece 4100, the space or opening defined by first bail body mating elements 5721*a* and 5721*b* and first bail casing or covering 5721*c* is sized and shaped to accommodate the first bail cover mating element 5731. When the jewelry piece 5100 is closed, the first bail cover mating element 5731 is inserted into the space or opening defined by the first bail body mating elements 5721*a* and 5721*b* and thus interlocking to form first bail 5700. Further, when the jewelry piece 5100 is closed, first bail body openings 5723*a*, 5723*b*, and first bail cover opening 5733 together form first bail opening 5710.

Figure 30:
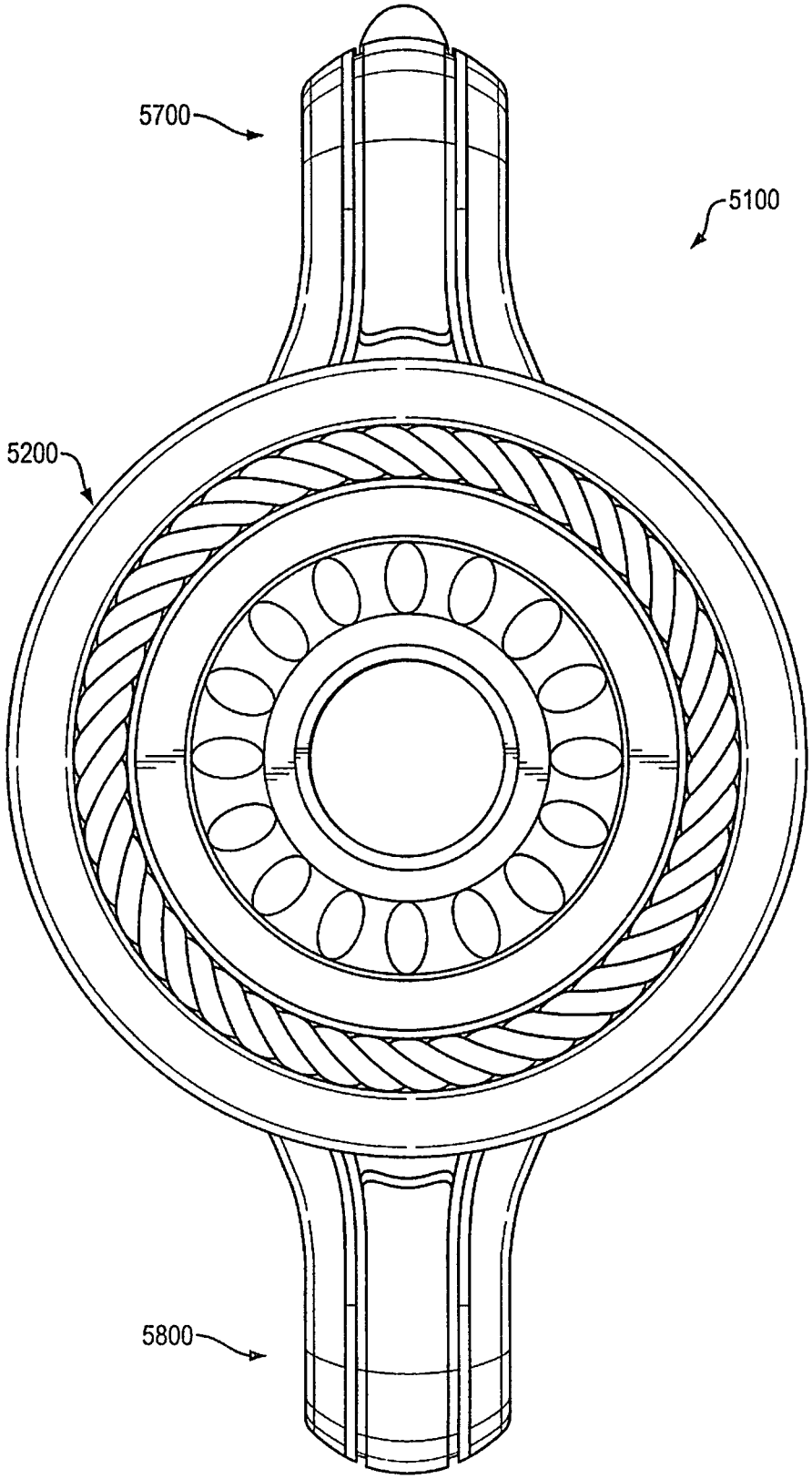
FIG. 30 is a front view of a jewelry piece for an interchangeable ornament in a closed position, in accordance with an eight embodiment of the invention.
Figure 31:
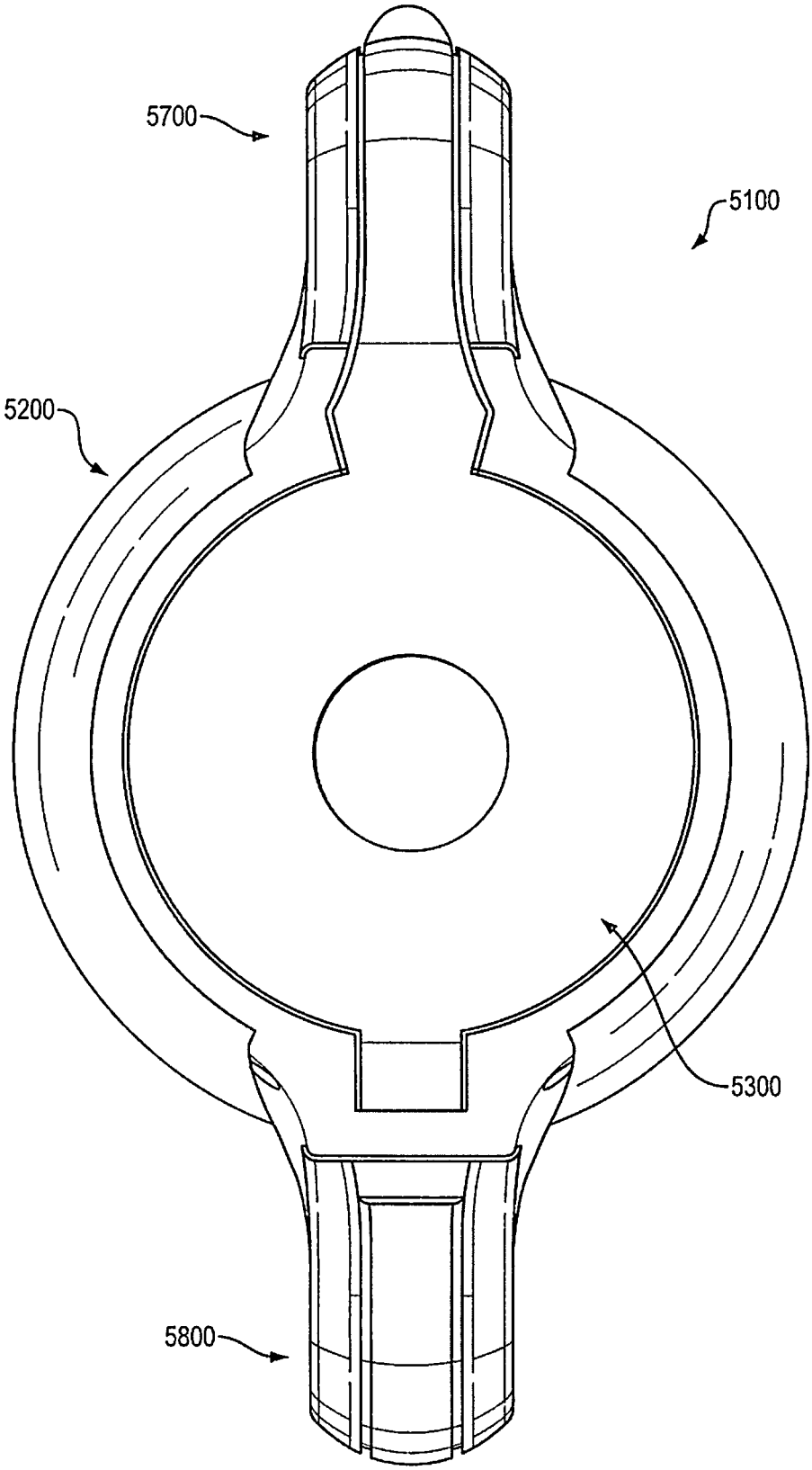
FIG. 31 is a back view of the jewelry piece of FIG. 30.
Figure 32:
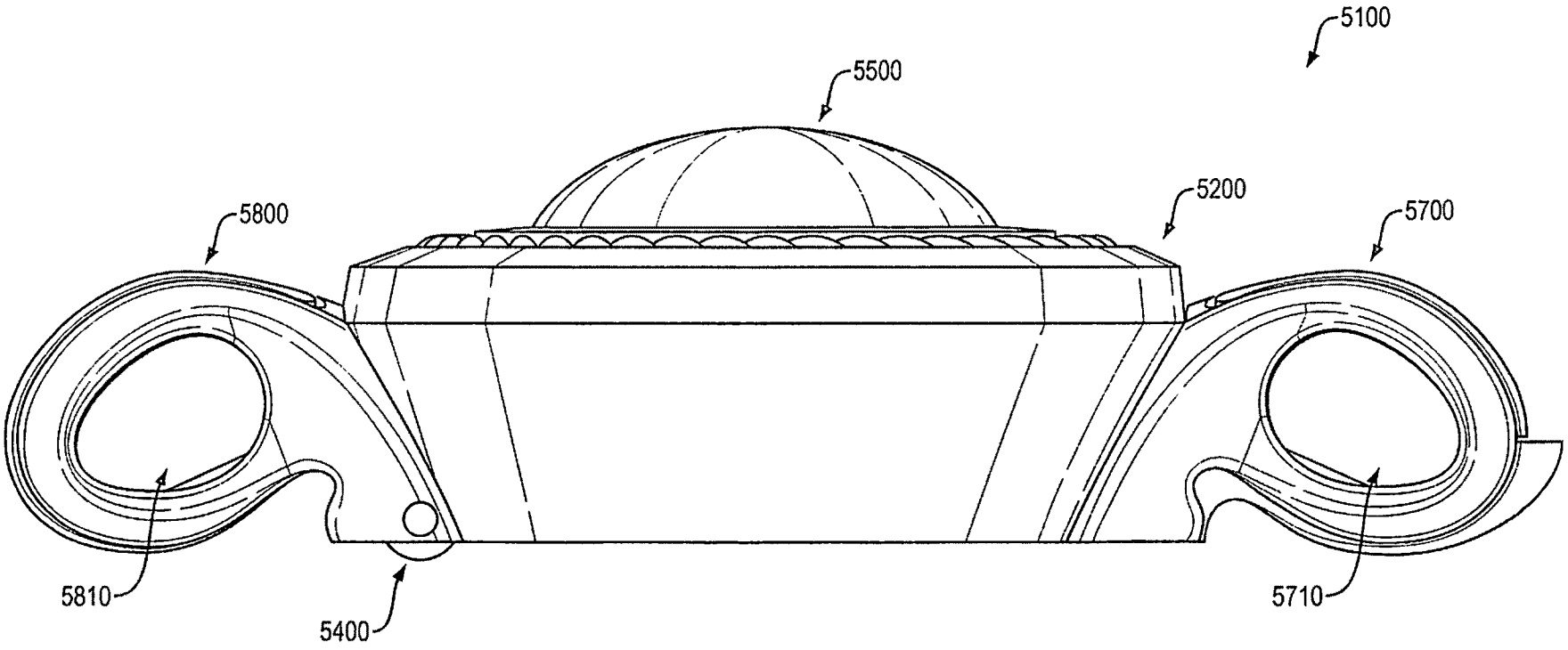
FIG. 32 is a side view of the jewelry piece of FIG. 30, with the addition of an exemplary ornament.
Figure 33:
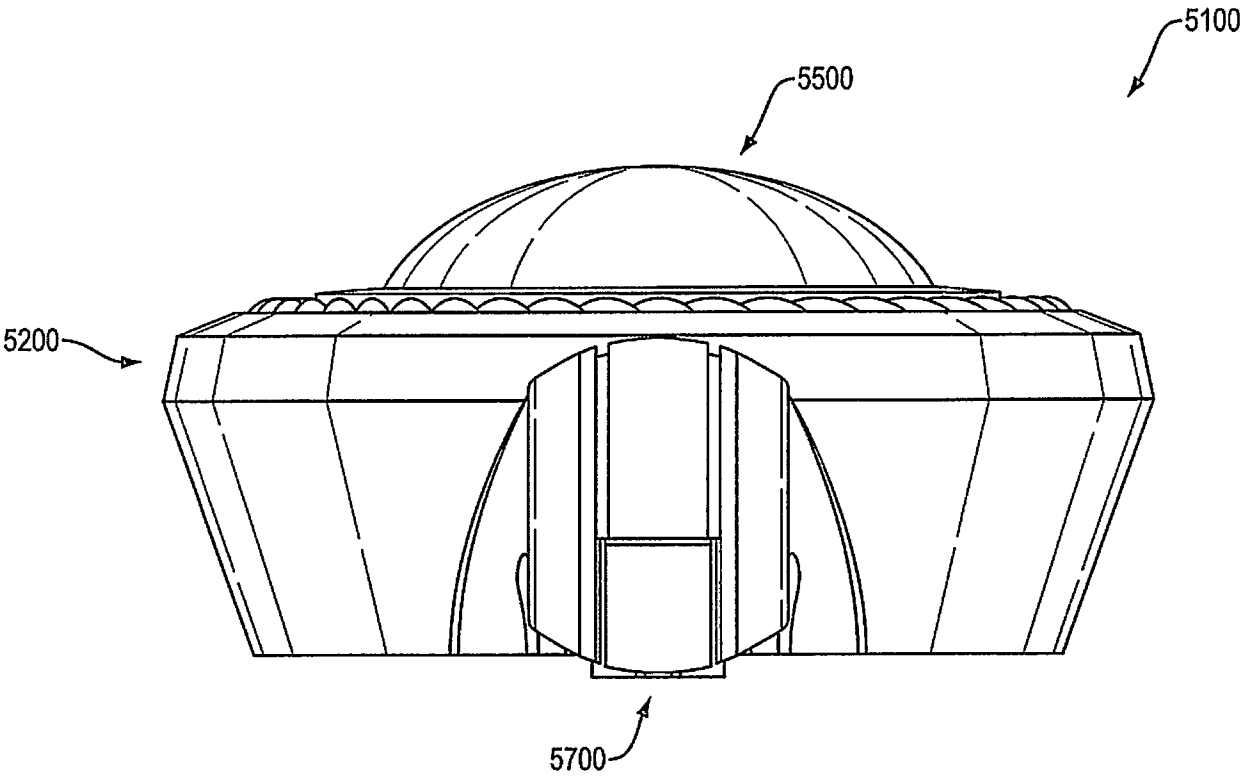
FIG. 33 is a top view of the jewelry piece of FIG. 32.

Jewelry piece 5100 differs from jewelry pieces 100 and 4100 in that jewelry piece 5100 has a second bail 5800 that is preferably located at the distal end of jewelry piece 5100, approximately opposite first bail 5700, and proximate hinge 5400, as shown in FIGS. 30-32. Second bail 5800 is preferably integral to body or housing 5200.

In a preferred embodiment, second bail 5800 is a loop or ring having a substantially oval or circular shape. In alternate embodiments, second bail 5800 may have any substantially contiguous shape. In a preferred embodiment, second bail 5800 defines a second bail opening 5810. Second bail opening 5810 preferably defines a substantially oval or circular shape. In alternate embodiments, second bail opening 5810 may define any substantially contiguous shape.

In a preferred embodiment, second bail 5800 is substantially similar in size and shape to first bail 5700, and second bail opening 5810 is substantially similar in size and shape to first bail opening 5710, although these are not limitations of the invention. In a preferred embodiment, second bail 5800 is different from first bail 5700 in that second bail 5800 does not open. In an additional embodiment, second bail 5800 may be substantially the same as first bail 5700. In additional alternate embodiments, second bail 5800 may be substantially the same as bail 700 of jewelry piece 100 or substantially the same as bail 4700 of jewelry piece 4100.

Figure 37:
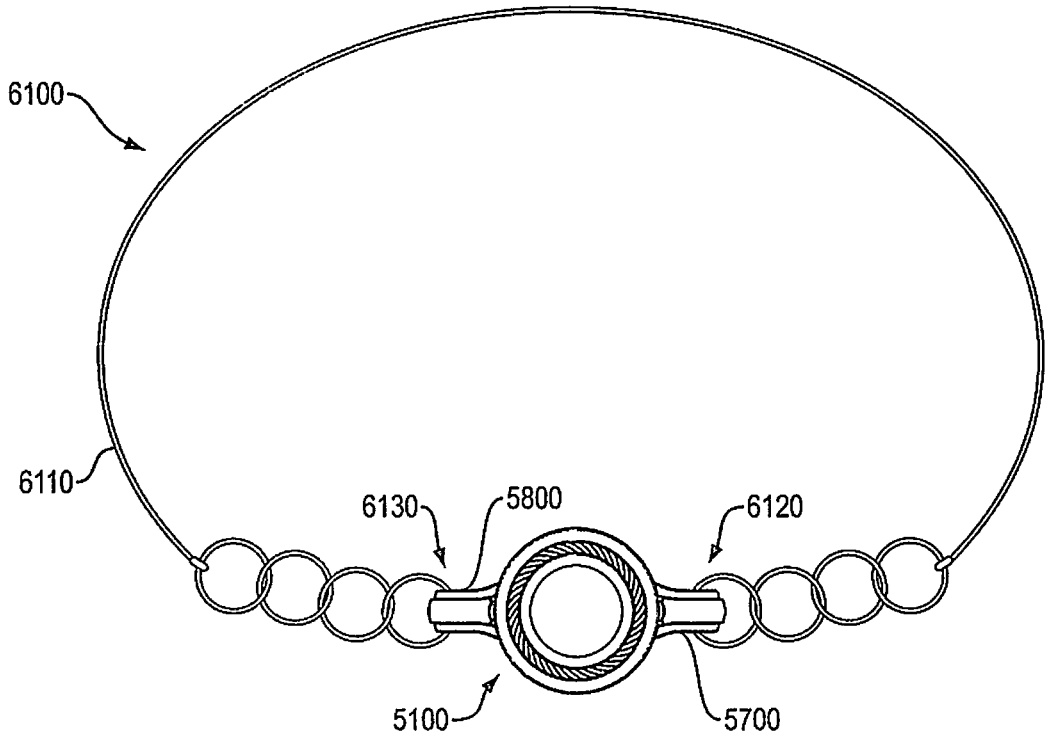
FIG. 37 is a perspective view of a jewelry piece, shown as a necklace, for an interchangeable ornament, in accordance with a ninth additional embodiment of the invention.

In alternate embodiments, and as shown in FIG. 37, jewelry piece 5100 may be used with a chain, cord, or string of beads or other decorative elements 6110, all of which may be comprised of any suitable material, to form a necklace 6100. As shown in FIG. 37, one end of chain 6110 is coupled to first bail 5700, while the opposite end of chain 6110 is coupled to second bail 5800. In a preferred embodiment, a first clasp 6120, such as a lobster clasp, toggle clasp, or spring ring clasp, may be used to removably couple chain or cord 6110 to first bail 5700, and a second clasp 6130 such as a lobster clasp, toggle clasp, or spring ring clasp, may be used to removably couple chain or cord 6110 to second bail 5800. In an alternate embodiment, chain or cord 6110 is permanently affixed to second bail 5800. In additional embodiments, a chain, cord, string of beads or other decorative element 6110 may be inserted through both the first bail 5700 and the second bail 5800 to form a necklace 6100.

Figure 38:
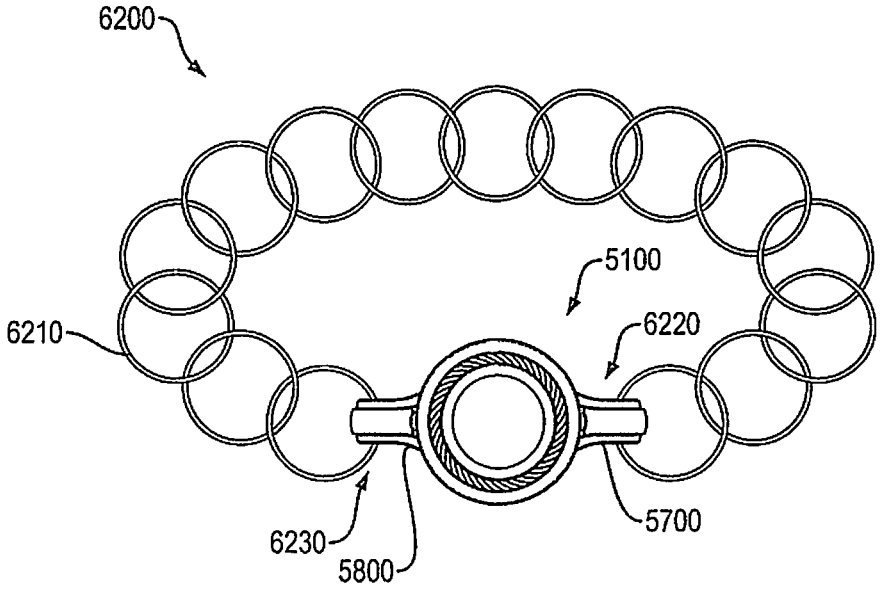
FIG. 38 is a perspective view of a jewelry piece, shown as a bracelet, for an interchangeable ornament, in accordance with a tenth additional embodiment of the invention.

In a similar, additional embodiment, and as shown in FIG. 38, jewelry piece 5100 may be used with a short chain, cord, or string of beads or other decorative elements 6210, all of which may be comprised of any suitable material, to form a bracelet 6200. As shown in FIG. 38, one end of chain 6210 is coupled to first bail 5700, while the opposite end of chain 6210 is coupled to second bail 5800. In a preferred embodiment, a second clasp 6220, such as a lobster clasp, toggle clasp, or spring ring clasp, may be used to removably couple chain or cord 6210 to first bail 5700, and a second clasp 6230 such as a lobster clasp, toggle clasp, or spring ring clasp, may be used to removably couple chain or cord 6210 to second bail 5800. In an alternate embodiment, chain 6210 is permanently affixed to second bail 5800. In additional embodiments, a chain, cord, string of beads or other decorative element 6210 may be inserted through both the first bail 5700 and the second bail 5800 to form a bracelet 6200.

Hinge 400 is preferably a barrel hinge. In alternate embodiments, hinge 400 may be a spring hinge, cylindrical hinge, or any other suitable hinge or closure that allows jewelry piece 100 to open and close. With reference to FIG. 2, hinge 400 is adapted and configured to minimize exterior evidence of the interchangeability of the ornament 500, and is not visible from the front of the jewelry piece 100. As shown in FIG. 3, when coupled to both the cover bottom surface 320 and the body bottom surface 220, the length and width of hinge 400 do not exceed the circumference of body bottom surface 220. Hinges 1400, 2400, 4400 and 5400 are preferably substantially the same as hinge 400.

With reference to FIGS. 21-24, and 37-38, and in additional embodiments, the jewelry pieces of the invention may be part of a collection of jewelry pieces adapted and configured to accept the same interchangeable ornament. For example, necklaces 3100 and 6100, and bracelets 3200 and 6200 may accept the same size and shape ornament, or set of ornaments of different materials or colors. Further, two or more of the jewelry pieces in a collection may be worn at the same time, with each jewelry piece having a matching ornament, or with the jewelry pieces having coordinating or complementary ornaments. For example, pendant necklace 3000 may be worn together with earrings 3300, with pendant necklace 3000 having a diamond ornament and earrings 3300 having coordinating ruby ornaments, or with both pendant necklace 3000 and earrings 3300 having matching sapphire ornaments. Note that all of these embodiments may include additional adornments, including but not limited to etching, embossing, tassels, chains, and decorative stones or beads.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A jewelry piece for an ornament, the jewelry piece comprising:

a housing comprising a housing first bail mating section, the housing defining a cavity for receiving the ornament, the housing open at opposing ends with an open top end having a portion that abuts an upper portion of the ornament when the ornament is received in the housing so as to display a crown of the ornament in an open top of the housing;

a cover comprising a cover first bail mating section, the cover coupled to an open bottom end of the housing to be moveable to a closed position overlying at least a portion of a bottom end of the housing;

where the ornament is held in abutment against a housing top end when the housing first bail mating section and the cover first bail mating section interlock to form a first bail when the cover is in the closed position; and where the housing further comprises a second bail located approximately opposite the first bail when the cover is in the closed position.

2. The jewelry piece of claim 1, where the housing first bail mating section comprises a first housing bail mating element and a second housing bail mating element; and where the first housing bail mating element and the second housing bail mating element together define a space that is sized and shaped to accommodate the cover first bail mating section when the cover is in the closed position.

3. The jewelry piece of claim 2, where the first housing bail mating element, the second housing bail mating element, and the cover first bail mating section each define an opening; and the opening defined in the first housing bail mating element, the opening defined in the second housing bail mating element, and the opening defined in the cover first bail mating section align and together form an opening in the first bail when the cover is in the closed position.

4. The jewelry piece of claim 1, where the housing first bail mating section comprises a first housing bail mating element and a second housing bail mating element; and where the cover first bail mating section is inserted into a space between the first housing bail mating element and the second housing bail mating element to form the first bail when the cover is in the closed position.

5. The jewelry piece of claim 4, where the first housing bail mating element, the second housing bail mating element, and the cover first bail mating section each define an opening; and the opening defined in the first housing bail mating element, the opening defined in the second housing bail mating element, and the opening defined in the cover first bail mating section align and together form an opening in the first bail when the cover is in the closed position.

6. The jewelry piece of claim 1, further comprising a magnetic closure having at least one magnet.

7. The jewelry piece of claim 6, where the magnetic closure is located proximate the first bail.

8. The jewelry piece of claim 1, the housing further comprising a housing magnet; the cover further comprising a cover magnet; and where the housing magnet and the cover magnet are magnetically coupled when the cover is in the closed position.

9. The jewelry piece of claim 8, where the housing magnet is located proximate the housing first bail mating section and the cover magnet is located proximate the cover first bail mating section.

10. The jewelry piece of claim 1, where the housing cavity is sized and shaped to substantially conform to a size and a shape of the ornament.

11. The jewelry piece of claim 1, the cover open at opposing ends, with an open top end having a portion that abuts a lower portion of the ornament when the ornament is received in the housing so as to display a portion of the ornament in an open bottom end of the cover.

12. The jewelry piece of claim 1, where the housing and the cover are substantially annular; and a circumference of the bottom end of the housing is greater than a circumference of the cover.

13. The jewelry piece of claim 1, where the housing is coupled to the cover by a hinge, and a length of the hinge is less than a length of the housing and a width of the hinge is less than a width of the housing.

14. The jewelry piece of claim 1, where a portion of the cover abuts a lower portion of the ornament when the cover is in the closed position.

15. The jewelry piece of claim 1, further comprising a support member substantially contained in a channel defined in the cover, a portion of the support member abutting a lower portion of the ornament when the cover is in the closed position.

16. A setting for an ornament, the setting comprising:

a body defining a void for removably receiving the ornament and comprising a body first coupling member, an open top, a bottom, and a perimeter wall connecting the top and the bottom;

a back hingedly connected to the body and comprising a back first coupling member;

where the body first coupling member comprises a first body coupling element and a second body coupling element, and where the first body coupling element, the second body coupling element, and the back first coupling member each define an opening;

where the setting is in a locked position when the body first coupling member and the back first coupling member engage to form a first bail and the opening defined in the first body coupling element, the opening defined in the second body coupling element, and the opening defined in the back first coupling member are positioned so as to form an opening in the first bail;

where the setting is moveable to an unlocked position when the body first coupling member and the back first coupling member disengage;

where a portion of the ornament is visible through the open top of the body when the ornament is received in the body and the setting is in the locked position; and where the body further comprises a second bail located approximately opposite the first bail when the setting is in the locked position.

17. The setting of claim 16, where the back first coupling member is positioned in a space between the first body coupling element and the second body coupling element to form the first bail when the setting is in the locked position.

18. The setting of claim 16, further comprising a magnetic closure having at least one magnet; and where the magnetic closure is located proximate the first bail.

19. The setting of claim 16, the body further comprising a body magnet located proximate the body first coupling member;

the back further comprising a back magnet proximate the back first coupling member; and where the body magnet and the back magnet are magnetically coupled when the setting is in the locked position.

20. A jewelry piece for an ornament, the jewelry piece comprising:

a housing comprising a housing magnet and a housing first bail mating section, the housing defining a cavity for receiving the ornament, the housing open at opposing ends with an open top end having a portion that abuts an upper portion of the ornament when the ornament is received in the housing so as to display a crown of the ornament in an open top of the housing;

a cover comprising a cover magnet and a cover first bail mating section, the cover coupled to an open bottom end of the housing to be moveable to a closed position overlying at least a portion of a bottom end of the housing;

where the housing first bail mating section comprises a first housing bail mating element and a second housing bail mating element;

where the ornament is held in abutment against a housing top end when the cover first bail mating section is positioned in a space between the first housing bail mating element and the second housing bail mating element to form a first bail when the cover is in the closed position;

where the housing magnet and the cover magnet are magnetically coupled when the cover is in the closed position; and where the housing further comprises a second bail located approximately opposite the first bail when the cover is in the closed position.

* * * * *